US010905620B2

(12) United States Patent
Hubschmid

(10) Patent No.: US 10,905,620 B2
(45) Date of Patent: Feb. 2, 2021

(54) THERAPY DEVICE

(71) Applicant: U-Sana Medical AG, Oberwill (CH)

(72) Inventor: Benjamin Hubschmid, Effingen (CH)

(73) Assignee: U-Sana Medical AG, Oberwil (CH)

( * ) Notice: Subject to any disclaimer, the term of this patent is extended or adjusted under 35 U.S.C. 154(b) by 617 days.

(21) Appl. No.: 14/911,083

(22) PCT Filed: Jul. 17, 2014

(86) PCT No.: PCT/EP2014/065407
§ 371 (c)(1),
(2) Date: Feb. 9, 2016

(87) PCT Pub. No.: WO2015/022142
PCT Pub. Date: Feb. 19, 2015

(65) Prior Publication Data

US 2016/0175182 A1 Jun. 23, 2016

(30) Foreign Application Priority Data

Aug. 12, 2013 (DE) ..... 10 2013 108 701

(51) Int. Cl.
*A61H 1/02* (2006.01)
*A61H 7/00* (2006.01)

(52) U.S. Cl.
CPC ..... *A61H 7/002* (2013.01); *A61H 1/0237* (2013.01); *A61H 1/0266* (2013.01); (Continued)

(58) Field of Classification Search
CPC . A61H 1/00; A61H 1/005; A61H 1/02; A61H 1/0237; A61H 1/0207; A61H 2001/0203; A61H 2001/027; A61H 2015/0007; A61H 2015/0042; A61H 15/0078; A61H 2201/0119; A61H 2201/0138; A61H 2201/0149; A61H 2201/0157; A61H 2201/12; A61H 2201/14; A61H 2201/0173; A61H 2201/1657; A61H 2205/10; A61H 2205/12; A61H 1/0266; (Continued)

(56) References Cited

U.S. PATENT DOCUMENTS 1,459,333 A * 6/1923 Hipwood ..... A61H 3/02 135/72
1,911,390 A * 5/1933 Pullman ..... A61H 1/0266 482/79

(Continued)

FOREIGN PATENT DOCUMENTS

WO WO2006/058442 A1 6/2006

OTHER PUBLICATIONS

International Search Report issued in International Application No. PCT/EP2014/065407 dated Mar. 17, 2015.

*Primary Examiner* — Michael J Tsai
(74) *Attorney, Agent, or Firm* — Hoffmann & Baron, LLP

(57) ABSTRACT

The invention relates to a therapy device for the postoperative treatment of body parts and portions thereof, in particular the large toe, having a main part and a moving segment with a support surface for supporting the body part to be treated. The moving segment is mounted on the main part in a pivotal manner about a pivot axis, and the main part is designed to optionally bear an extremity support on the left and right side.

21 Claims, 18 Drawing Sheets

(52) U.S. Cl.
CPC ..... *A61H 1/0274* (2013.01); *A61H 2001/027* (2013.01); *A61H 2201/164* (2013.01); *A61H 2205/12* (2013.01)

(58) Field of Classification Search
CPC ..... A61H 1/027; A61H 2201/164; A61H 2201/1642
USPC ..... 601/23, 24
See application file for complete search history.

(56) References Cited

U.S. PATENT DOCUMENTS 2,002,586 A * 5/1935 Ryberg, Jr. ..... A61H 1/0266 601/21
4,862,875 A * 9/1989 Heaton ..... A61H 1/0266 601/26
5,029,575 A * 7/1991 Zhivotchenko ..... A61H 23/02 36/141
5,094,226 A 3/1992 Medcalf et al.
5,176,598 A * 1/1993 Gardner ..... A61H 1/0266 482/79
5,267,924 A * 12/1993 Miller ..... A61H 1/0266 482/79
5,297,540 A 3/1994 Kaiser et al.
5,411,044 A * 5/1995 Andolfi ..... A61G 7/1017 135/66
5,848,979 A * 12/1998 Bonutti ..... A61F 5/013 601/5
7,565,755 B2 * 7/2009 Tvoua ..... A43B 3/108 36/11.5
9,220,941 B2 * 12/2015 Barry ..... A63B 21/00181
9,364,382 B1 * 6/2016 Cooper ..... A61H 1/0237
9,682,004 B2 * 6/2017 Schmitt ..... A61H 1/0237
2006/0116619 A1 * 6/2006 Weinstein ..... A61H 1/0266 602/32
2007/0100267 A1 * 5/2007 Bonutti ..... A61H 1/02 602/23
2007/0299372 A1 * 12/2007 Chang ..... A61H 1/0266 601/28
2008/0051682 A1 2/2008 Thomas
2009/0036814 A1 * 2/2009 Bonutti ..... A61F 5/013 602/22
2009/0149783 A1 6/2009 Nef et al.
2010/0234776 A1 9/2010 Borden
2011/0004335 A1 * 1/2011 Summit ..... A61F 2/5046 700/119
2013/0006155 A1 * 1/2013 Tassin ..... A61H 1/008 601/27
2014/0031728 A1 * 1/2014 Guillen ..... A61H 1/0259 601/34

* cited by examiner

THERAPY DEVICE

CROSS-REFERENCE TO RELATED APPLICATIONS

This application is the U.S. National Phase of, and Applicant claims priority from, International Application No. PCT/EP2014/065407, filed 17 Jul. 2014, and European Patent Application No. DE 10 2013 108 701.9, filed 12 Aug. 2013, both of which are incorporated herein by reference in their entirety.

BACKGROUND

The invention relates to a therapy device, in particular for the postoperative treatment of body parts and (end) portions thereof, in particular the large toe, according to the preamble of claim 1, to an extremity support according to claim 12, and to a kit according to claim 16.

Therapy devices of the type in question here are known from U.S. Pat. No. 5,297,540, for example. They comprise a rigid foot support and a pivot mechanism with a rotation axis and a toe support. By means of the pivot mechanism, the large toe (also called the hallux) can be supported in a pivotable manner, wherein the toe support usually has fixing means for fixing the large toe. The pivot mechanism thus serves to move the large toe, in particular for the postoperative treatment of abnormal positioning of the large toe, for example hallux valgus, a pathological state of tilting of the large toe, and of arthroses. Corresponding therapy devices can also be used for other joints, e.g. for wrists, fingers or knee joints. To achieve a good therapeutic outcome, the pivoting movement of the body part to be treated, which movement brings about dorsiflexion (the bending of a moving segment in the dorsal direction) and plantar flexion (the movement of the foot or of the toe in the direction of the sole), has to be adapted to the anatomical circumstances of the specific body part. Moreover, it has been shown that conventional therapy devices are often unwieldy and, in particular, are unsuitable for mobile use.

SUMMARY

The object of the present invention is therefore to make available an improved therapy device which serves for the postoperative treatment of joints and which is adaptable in a particularly flexible way to the anatomical circumstances of the joint to be treated and, in addition, has a compact and space-saving design and is thus suitable in particular for transport.

In order to achieve the abovementioned object, a therapy device having the features of claim 1 is proposed. The therapy device serves for the postoperative treatment of joints, in particular the joint of the large toe, and has a main body and a moving segment with a support surface for supporting the joint to be treated. The moving segment is mounted on the main body in such a way as to be pivotable about a rotation axis. Moreover, according to the invention, the main body is designed to optionally bear an extremity support on the left-hand side and right-hand side.

An essential aspect of the invention is therefore that the therapy device has a modular configuration with a main body. An extremity support can be mounted on, and in particular attached to, the main body, both on the left-hand side and also on the right-hand side with respect to its longitudinal axis, which extremity support serves, for example, to support a left or right foot during treatment of incorrect functioning or abnormal positioning of joints, such as hallux valgus, or of arthroses, using the therapy device. In this way, the therapy device has a particularly compact design for transport, since the extremity support can be formed separately from the main body and can be removable from the latter. The main body can thus be transported and stored separately from the (bulky) extremity support. Alternatively, it is conceivable for the extremity support to be stowed in a kind of cassette, which can be integrated in the main body. The connection of the extremity support to the main body can be effected, when necessary, simply by means of a snap-fitted, clipped, locked or clamped connection, for example. Alternatively, the extremity support can be secured pivotably on the main body such that, by simply swiveling the extremity support around a longitudinal axis of the main body, it can be mounted on the left-hand side and on the right-hand side. A particular advantage of the invention is therefore that the extremity support can be connected to the main body both from the left-hand side and also from the right-hand side, such that the therapy device can be used particularly flexibly for body parts on the right half of the body and also on the left half of the body. Therefore, besides being particularly compact and cost-effective in design, the therapy device according to the present invention can also be used in a versatile and particularly simple manner. In order to ensure optimal handling of the therapy device, the main body is preferably substantially symmetrical with respect to a longitudinal axis, such that the extremity support can easily be arranged optionally on the left-hand side or right-hand side of the main body.

A therapy device is particularly advantageous in which the rotation axis of the moving segment substantially coincides with the anatomical rotation axis of the body part to be treated. In this way, the pivoting movement of the moving segment is adapted particularly effectively to the anatomical circumstances of the large toe.

A therapy device is also particularly preferable in which the support surface is connected to the moving segment in a releasable and/or displaceable manner. This design permits the exchange of the support surface, such that the main body can cooperate with different support surfaces, for example for different patients or different body parts. This also permits easy cleaning of the support surface. A connection between the support surface and the moving segment can be provided, for example, by means of snap-fitting, locking, clamping or clipping elements, which allow the support surface to be easily released from the moving segment without aids. However, it is also conceivable in principle for the support surface to be formed in one piece with the moving segment, such that the support surface thus forms an integral component of the moving segment. Moreover, the support surface preferably has a fixing mechanism by which the body part to be treated (joint) can be fixed on the support surface, such that the body part follows the movement profile of the moving segment. For example, the fixing mechanism can be in the form of one or more straps extending over the body part, which is located on the support surface, and bearing on said body part.

To ensure that the body part to be treated is mounted movably on the support surface, the support surface is preferably mounted so as to be displaceable relative to the moving segment. For this purpose, the support surface can have a plurality of embedded movable ball elements, for example. Alternatively, a variant is preferred in which a double carriage is provided as support surface for the respective body part to be treated. Moreover, at least one roller element can serve as support surface for the joint to be treated, the rotation axis of the roller element extending transversely with respect to the longitudinal direction of the main body. In this way, the body part to be treated can be moved in all directions on the support surface during a movement of the moving segment. By virtue of the body part to be treated being mounted movably, it is additionally possible to compensate for deviations of the centers of rotation of the moving segment and of the body part. Thus, if the rotation axis of the moving segment deviates from the anatomical rotation axis of the body part, the fixing position of the body part can be moved in such a way that an offset of the rotation axes is compensated. It is thus possible for the pivotable mounting of the body part to be adapted effectively to the anatomical circumstances, ensuring an improved outcome of the therapy provided by the therapy device according to the invention.

To ensure that the therapy device stands in a stable manner, the main body preferably has at least one releasable and/or displaceable stand, and in particular at least one recess for receiving the stand. Several stands are preferably provided, which can serve to support the main body and which in addition can advantageously support an extremity support secured on the main body. By virtue of the movable or releasable configuration of the stand or stands, they can be folded out or mounted in the state of use, whereas, in the state in which the therapy device is not in use, they can be arranged in a space-saving transport state. The stands can additionally be pivoted out. Moreover, the stands can also be adjustable such that an angle between the extremity support and a ground surface on which the main body is arranged can be modified. The adjustment can be effected by means of a rotary screw, for example. The angle can in this way be adapted to different positions of the user during therapy, for example to different seated positions, and can, for example, be about 10°-20°, in particular 15°.

A therapy device is also particularly preferred in which the support surface is delimited by at least one lateral web to prevent bruising of the body part to be treated. The web can be provided either directly on the support surface or on an extremity support connectable to the main body.

A therapy device is moreover preferred in which the main body comprises an integrated drive mechanism for manual (e.g. using a lever) or electrical displacement of the moving segment. For example, the drive mechanism can be a threaded spindle drive or an arc segment drive. Preferably, provision can also be made that the drive mechanism cooperates with an overload safety system. For this purpose, a corresponding control system preferably interacts with the drive mechanism in such a way that it detects when the drive mechanism is switched off in the event of an excess load on the moving segment. An overload state of this kind can be detected, for example, by an increase in the torque of the drive mechanism or a reduction in the speed of the moving segment. Alternatively, in order to provide an overload safety system, the pressure of the body part to be treated, in particular of the large toe, on the support surface can be measured. For this purpose, a pressure sensor is preferably provided which can be integrated in the support surface. If the toe pressure becomes too great, the pressure sensor can generate a corresponding signal, which causes a control system to stop the pivoting movement of the moving segment.

In order to achieve the abovementioned object an extremity support having the features of claim 12 is also proposed. The extremity support comprises connection means for releasably connecting the extremity support to the main body of a therapy device according to the invention. The extremity support is preferably adjustable in size and can thus be adapted individually to different patients. A heel part adjustable in the vertical and/or longitudinal direction is particularly advantageous. Alternatively, break segments, for example, can also be provided which allow the extremity support to be individually adapted in size to a patient. The extremity support preferably has fixing means, in particular in the form of tapes or straps, for fixing the extremities to the extremity support. Finally, the extremity support can be designed as an injection molded part, as a result of which production can be particularly simple and cost-effective.

Finally, in order to achieve the abovementioned object, a kit having the features of claim 16 is also proposed, which kit comprises a therapy device according to the invention and, connectable to said device, an extremity support according to the invention, wherein the extremity support is connectable to a main body of a therapy device according to the invention.

BRIEF DESCRIPTION OF THE DRAWINGS

The invention is explained in more detail below with reference to the drawing, in which.

DETAILED DESCRIPTION

Figure 1:
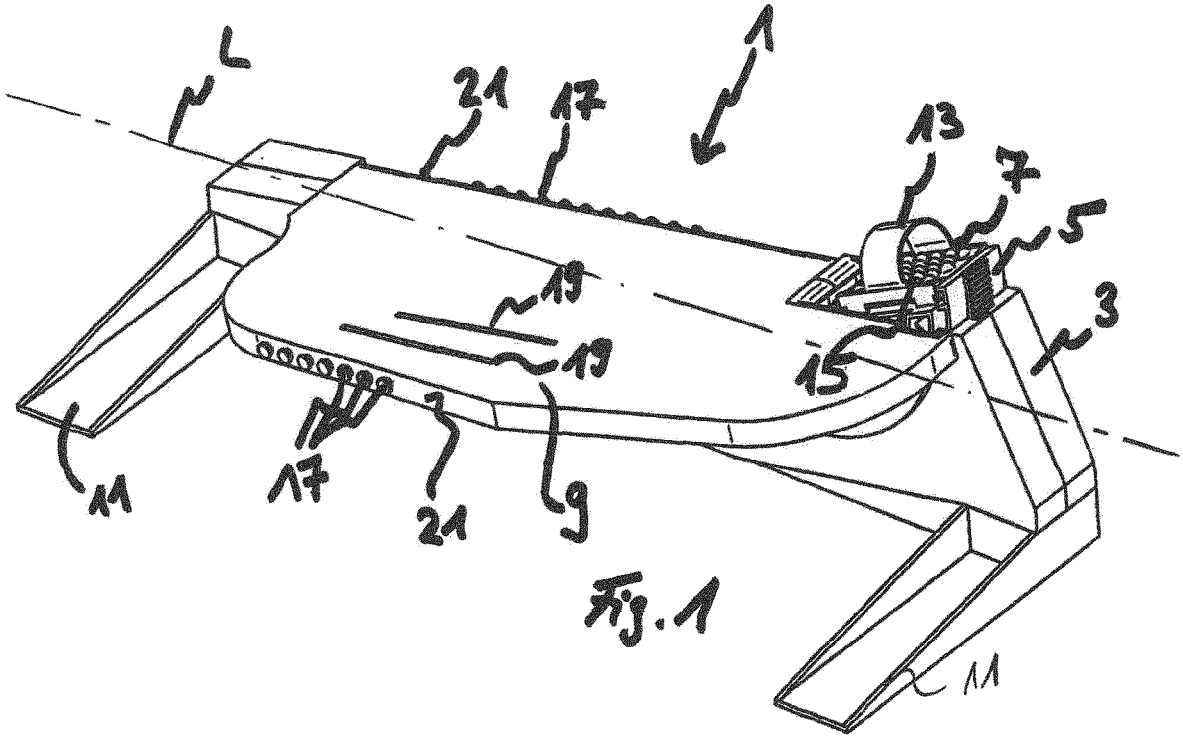
FIG. 1 shows a perspective view of a therapy device according to a first embodiment of the invention.

FIG. 1 shows a perspective view of a therapy device 1 for the postoperative treatment of body parts and (end) portions thereof. Specifically, the therapy device 1 shown in FIG. 1 serves, for example, for the treatment of hallux valgus, i.e. for the treatment of an oblique positioning of the large toe. The therapy device has a main body 3 (=housing) and a moving segment 5, which is mounted pivotably in and/or on the main body 3. The moving segment 5 is pivotably mounted in such a way that a body part arranged thereon alternately executes a cyclical extension movement (dorsiflexion) and a bending movement (plantar flexion), which movements go beyond a predetermined angle.

The moving segment 5 is connected to a substantially flat support surface 7 which can either be integrally connected to the moving segment 5 or is secured releasably thereon. The support surface 7 can be connected to the moving segment 5 by a clamped connection or snap-fit connection, for example.

A plate-shaped extremity support 9 is secured releasably on the main body 3 and, in the illustrative embodiment shown in FIG. 1, is arranged on the right with respect to a longitudinal axis L of the main body 3, such that the right foot can thus be arranged on it. The operating state of the therapy device 1 as shown in FIG. 1 thus serves, for example, for treatment of the large toe of the right foot, in which case the extremity support 9 serves to support the foot and the support surface 7 serves to support the large toe.

The therapy device 1 additionally comprises two stands 11 which can be mounted on, and in particular plugged onto, the underside of the main body 3, i.e. the face of the main body 3 directed toward the ground. It is also conceivable in principle to provide only one stand 11 or more than two stands made of metal or plastic, which stands can not only be plugged onto the main body 3 but can also alternatively be mounted rotatably or pivotably thereon. The important point is that the stands 11 provide the relatively narrow main body 3 with the required stability, particularly at the side on which the extremity support 9 is respectively arranged.

It is also clear from FIG. 1 that the support surface 7 for supporting the body part to be treated, in this case for treating a large toe for example, is provided with a fixing mechanism 13 in the form of a strap, which is intended to fix the large toe on the support surface 7 during a pivoting movement of the moving segment 5 (alternate dorsiflexion and plantar flexion). For this purpose, the fixing element 13 extends across the support surface 7 and crosses a large toe arranged on the support surface 7. Provision can also be made that the fixing element 13 is adjustable in length, in order to accommodate large toes of different sizes, or that it is made of an elastic and flexible material which, by virtue of its elasticity, can be flexibly adapted to large toes of different sizes. Moreover, provision can be made for the fixing mechanism 13 to be secured releasably on the support surface 7 in order to ensure its exchangeability.

The support surface 7 according to the illustrative embodiment shown in FIG. 1 comprises a plurality of freely rotatable ball elements 15, which are embedded in the support surface 7. To produce the "ball bed", the individual ball elements can simply be pressed by means of a snap-fit connection into corresponding openings on the top of the support surface. Preferably, the ball elements 15 cover substantially the entire support surface 7 and thus ensure that a large toe mounted on the support surface 7 is able to move in all directions on the support surface 7. It is in this way ensured that an optimal adaptation to the anatomical circumstances is guaranteed by the therapy device during a pivoting movement of the moving segment 5. However, it is in principle also conceivable to provide a support surface in the form of a dual-movement carriage, which ensures the required mobility of the body part on the moving segment 5. Alternatively, the support surface 7 can be designed as a linear carriage with or without a ball bed. In the present illustrative embodiment, the extremity support 9 comprises a series of mushroom-shaped knobs 17 which are arranged next to one another and extend at least over part of the two opposite side edges 21 of the extremity support 9. In addition, slits 19 are provided in the extremity support and serve to receive a strap, a tape or some other fixing element for fixing an extremity, for example a foot, mounted on the extremity support 9. The tape can then be guided with one end through one of the slits 19 and can be secured with the other end to suitable openings on the mushroom-shaped knobs 17. The different slits and the plurality of the knobs 17 serve to permit the variable securing of a strap or tape (for instep and/or heel), or a plurality thereof, such that the extremity support 9 is individually adaptable to extremities of different sizes and to particular anatomical circumstances.

Figure 2:
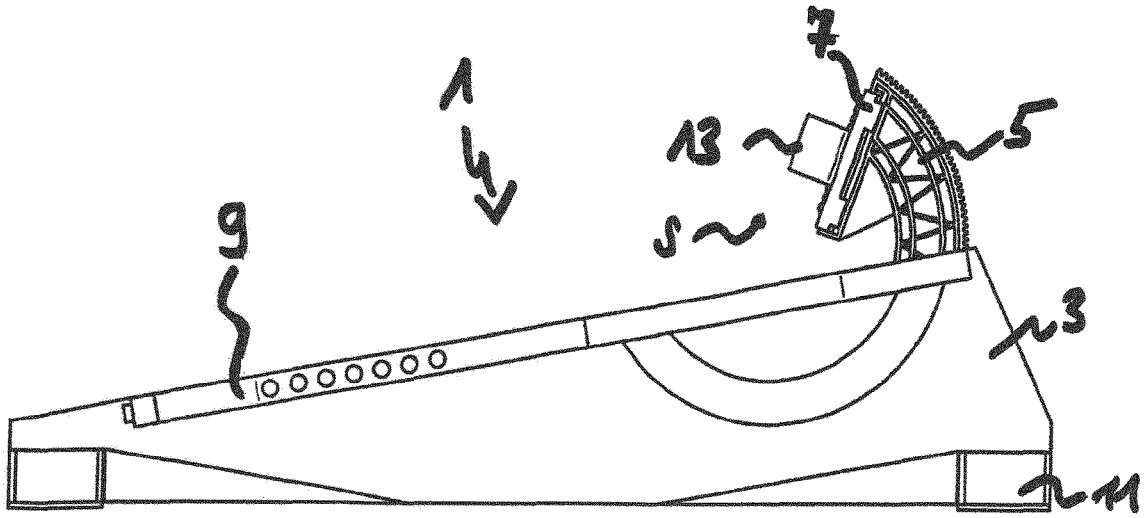
FIG. 2 shows a side view of the therapy device according to FIG. 1.

FIG. 2 shows a detail of the therapy device 1 according to FIG. 1 in a side view. In this operating state of the therapy device 1, the moving segment 5 is pivoted out to the full extent, hereinafter called "maximum dorsiflexion". In cases where the therapy device 1 is intended not for large toes but instead for other body parts or joints, e.g. wrists or elbow joints, this state can also entail a plantar flexion and not a dorsiflexion. In this operating state, the support surface 7 preferably encloses an angle of 60° with the plane of the extremity support 9. If other joints are to be treated, this angle can be different. In this embodiment of the invention, the moving segment 5 has the shape of an arc of a circle and, by means of a suitable drive mechanism integrated in the main body 3, is displaceable from maximum plantar flexion of the respective body part to be treated (in the present case the large toe) to maximum dorsiflexion.

It is also clear from FIG. 2 that the rotation axis S of the moving segment 5 does not lie in the plane of the extremity support 9 but above same, i.e. substantially in the area of the anatomical rotation axis of the body part to be treated, in this case the large toe. In this way, the movement of the moving segment 5 is adapted optimally to the anatomical circumstances of the body part to be treated, as a result of which a particularly good therapeutic effect is achieved. The same also applies when the therapy device according to the invention is not designed for the large toe but instead, for example, for an ankle joint, wrist, shoulder joint or similar body part.

Figure 3:
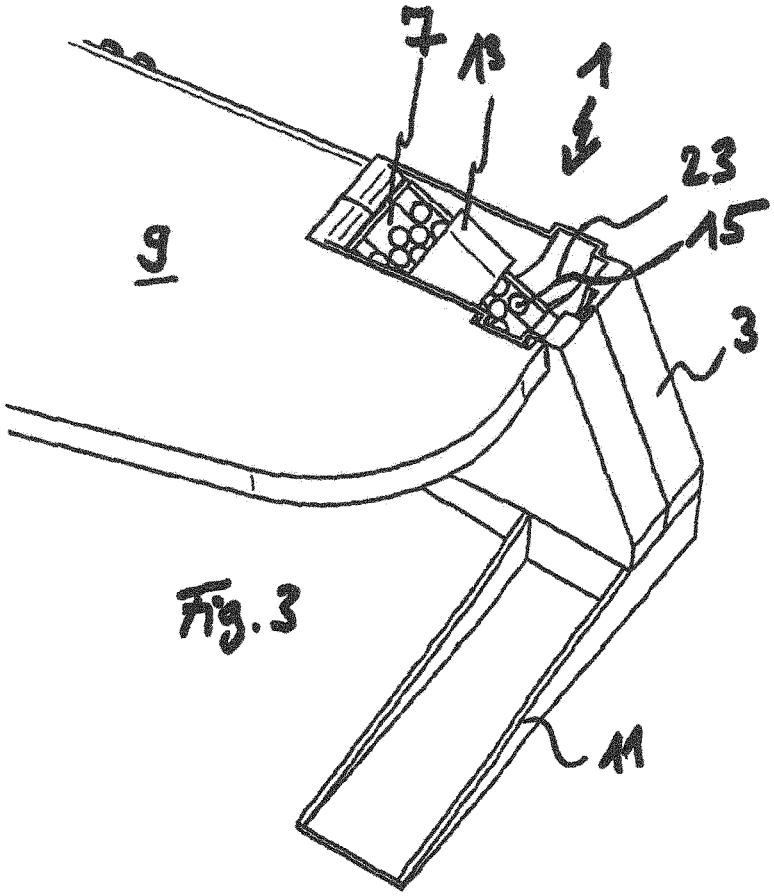
FIG. 3 shows a perspective view of a detail of the therapy device according to FIG. 1.

FIG. 3 shows a detail of the therapy device 1 from FIG. 1, in an operating state in which a large toe mounted on the support surface 7 is in a position of maximum plantar flexion. The maximum plantar angle is preferably ca. 30° with respect to a plane of the extremity support. If other joints are to be treated, this angle can be different. FIGS. 1-3 as a whole show clearly that the arc-shaped moving segment 5 is integrated in the main body 3 in such a way that the rotation axis S of the moving segment 5 is oriented substantially perpendicularly with respect to the longitudinal axis L of the main body 3. During the movement, the arc-shaped moving segment 5 shown in the embodiment according to FIGS. 1-3 engages through an opening 23 on the top of the main body 3, wherein the rectangular reception surface 7 for receiving the large toe fills the opening 23, preferably entirely, in order to prevent bruising of body parts.

Figure 4:
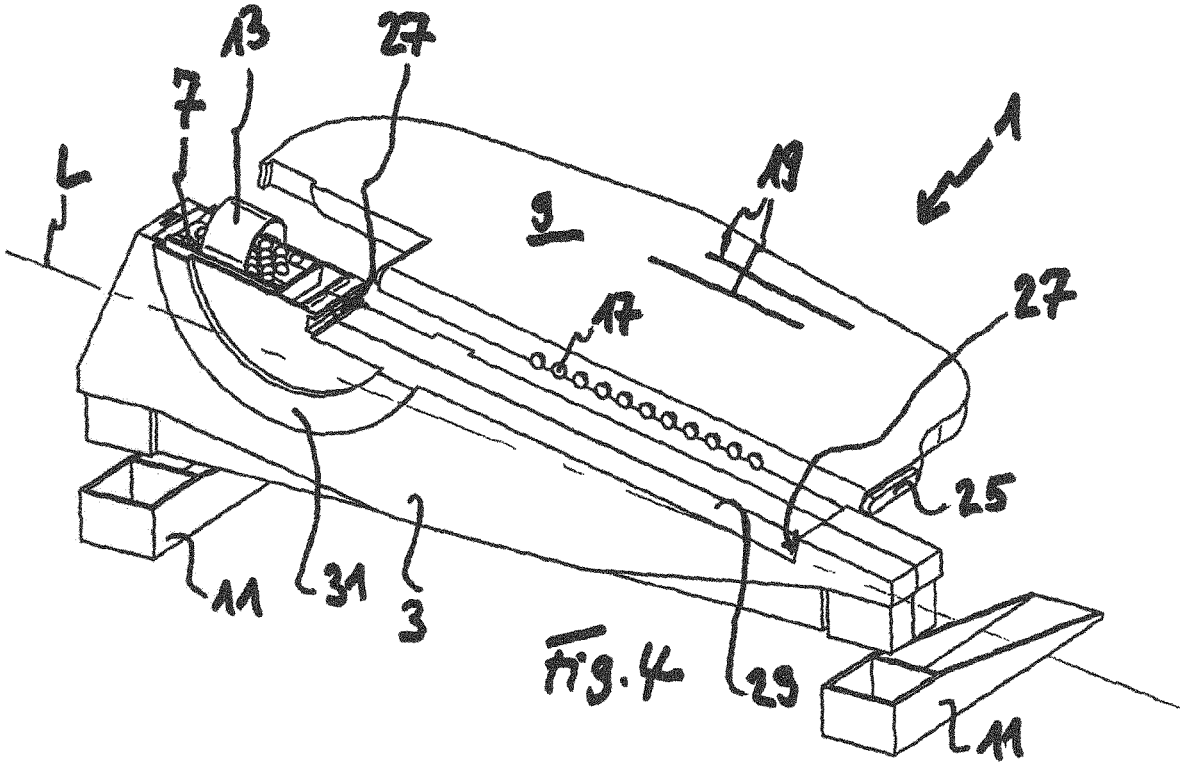
FIG. 4 shows an exploded view of a therapy device according to FIG. 1.

FIG. 4 shows an exploded view of the therapy device 1 according to FIG. 1. It is clear here that the extremity support 9 can be connected releasably to the main body 3. For this purpose, corresponding connection means 25 are provided on the extremity support 9 and, in the present case, are designed for example in the form of projections, which can be pushed into corresponding grooves 27 of the main body 3. A U-shaped recess 29 in the main body 3 serves to receive and bear the extremity support 9.

In the illustrative embodiment of the invention as shown in FIG. 4, the extremity support 9 is provided by a form-fit connection device. However, other types of connection are also possible, for example by latching, clamping or clipping means, which are able to provide a safe and easily releasable connection between the extremity support 9 and the main body 3.

The extremity support 9 is preferably identical on its top and on its underside and can therefore be used either way round. Specifically, it can be arranged on the right-hand side with respect to a longitudinal axis L of the main body 3 (as shown in FIG. 4) or on the left-hand side with respect to the longitudinal axis L of the main body 3. In this way, the extremity support 9 can serve not only to support the right foot and thus to treat the large toe of the right foot, but additionally, by simply being turned over and refitted, to support the left foot and thus the large toe of the left foot on the support surface 7.

As FIG. 4 shows, the main body 3 is preferably symmetrical with respect to the longitudinal axis L, such that a symmetrical use of the extremity support 9 is readily possible. It is not necessary to adjust or switch round the support surface 7. The extremity support 9 is shaped such that, in the assembled state, it adjoins the main body 3 with a form fit. This prevents gaps occurring between the extremity support 9 and the main body 3 or the support surface 7, which gaps can lead to bruising of limbs.

The main body 3, like the extremity support 9, is preferably an injection molded part that can be produced particularly simply and cost-effectively. However, the main body 3, the extremity support 9 and other parts of the therapy device can also be produced by 3D printing. Other suitable production methods may also be considered. For example, these parts can be milled from a block. The main body 3 is formed along the longitudinal direction L from two halves, which are joined together once the moving segment 5 and the corresponding drive means have been inserted into the main body 3. It is also clear from FIG. 4 that, in this way, a guide rail 31 can be easily shaped in the main body 3 and serves to guide the moving segment 5 in the main body 3.

Figure 5:
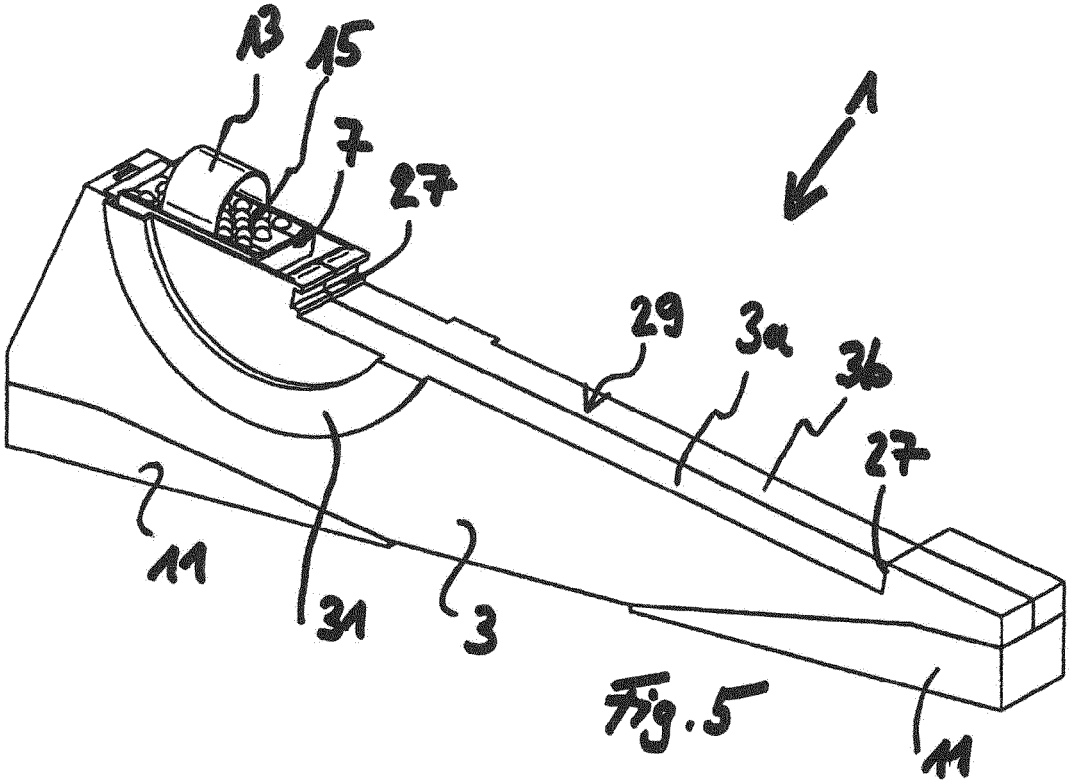
FIG. 5 shows a perspective view of a main body.

In the embodiment according to FIG. 4, the stands 11 are formed by separate parts which, by a suitable plug-in device, can be secured in different positions on the underside of the main body 3. The underside of the main body 3, in the longitudinal end areas thereof, is preferably designed in such a way that the end areas of the underside can be connected completely with a form fit to the stands 11, resulting in the transport state of the therapy device 1 as shown in FIG. 5. Moreover, in this transport state, the extremity support 9 is not connected to the main body 3. In this way, the therapy device 1 can be converted into a particularly compact unit for transport. When necessary, i.e. for operating the therapy device, the stands 11 can then be moved to their supporting position according to FIG. 1. If the extremity support 9 serves to support the left foot (not shown in the figures), the stands can also be oriented toward the left-hand side with respect to the longitudinal axis L. Thus, the stands can be used flexibly on both sides with respect to the longitudinal axis L of the main body 3.

Figure 6:
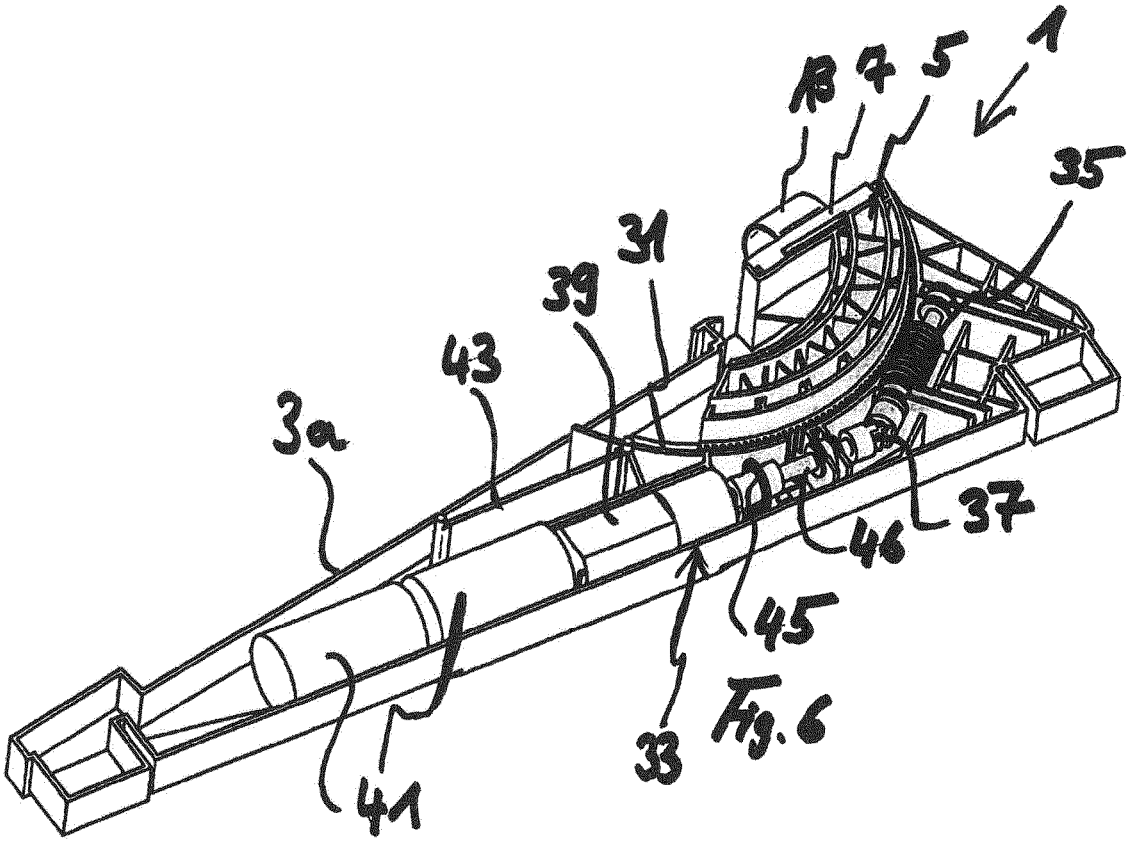
FIG. 6 shows a sectional view of the main body according to FIG. 5.

FIG. 6 shows an internal view of a half 3*a* of the main body 3, with the moving segment 5 which is mounted therein, bears on a guide rail 31 and is driven by a drive mechanism 33. The guide rail 31 can be formed integrally on the main body 3, for example, by injection molding, by 3D printing or by another suitable method.

In the illustrative embodiment according to FIG. 6, the arc-shaped moving segment 5 is driven by a worm gear 35, which is connected by a universal joint 37 to an electric motor 39 and can be driven by the latter. This motor can, for example, be a low-voltage motor which generates a different torque depending on the joint that is to be treated. The electric motor 39 is powered by accumulators 41, which are likewise integrated in the main body 3 (housing) connected to the electric motor. It will be appreciated too that the main body 3 can also have a mains connection, such that the use of accumulator cells 41 is rendered obsolete.

The electric motor 39 is connected to the universal joint 37 via a coupling 45 and a connection shaft 46. The coupling can be made of plastic and, in order to detect the position of the support surface 7, can have a slotted disk, which cooperates with a fork-shaped photoelectric barrier. Moreover, a limit switch can be provided which triggers at a position of maximum dorsiflexion or plantar flexion of the large toe.

Moreover, a control system 43 is provided which, for example, can be configured as an electronics module on a printed circuit board and which controls the function of the electric motor 39. For the pivotable movement of the moving segment 5, the worm gear 35 engages in toothing elements which are arranged on the outside of the arc-shaped moving segment 5, i.e. on the side facing toward the worm gear 35, and which are in particular injection molded there. The maximum excursion of the moving segment 5 in the direction of flexion and in the direction of extension is set by suitable abutment elements and/or limit switches. This purpose can be served by the fork-shaped photoelectric barrier described above and by the limit switch.

Using position determination of the moving segment 5, the control system knows at all times in which position the moving segment 5 is located. If the therapy device 1 is not switched off in the starting position in which the support surface 7 lies substantially in a plane with the extremity support 9, the therapy device must know the position in which it is located when switched back on. Ideally, the device then goes back automatically to the starting position and begins with a startup program. The checking of the position can be effected by various technical elements.

A mechanical overload safety system, for example in the form of a coupling, such as a slip coupling, friction coupling or magnetic coupling, can be provided between the connection shaft 46 and the electric motor 39. However, instead of a mechanical overload safety system, an electrical overload safety system can also be provided, for example by detecting the torque, i.e. the current consumption of the motor. In this case, the resistance of the large toe causes the motor itself to stop. Alternatively, or also in addition, a pressure sensor can be provided on the extremity support and, if necessary, permits the triggering of an emergency stop.

The control system 43 is also preferably provided with corresponding actuation mechanisms or adjustment mechanisms (not shown in the figure) for a person using the therapy device 1. For example, these can include suitable rocker switches and/or rotary buttons and/or push buttons or other actuation and adjustment devices, which are mounted on the main body 3. Alternatively, or also in addition, provision can be made that the drive mechanism 33 can be controlled remotely. It is also conceivable to implement remote control in a cell phone, for example with the aid of a suitable "app".

Figure 7:
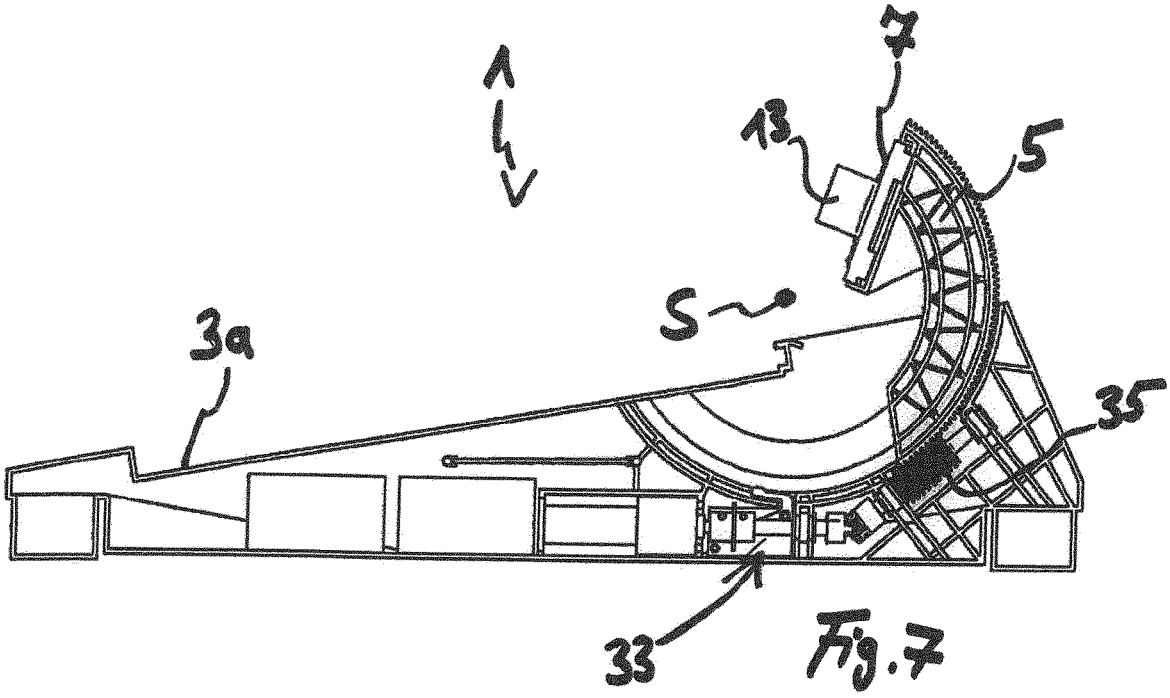
FIG. 7 shows a sectional view of the therapy device according to FIG. 2.

FIG. 7 shows a further side view of a detail of the housing half 3*a* according to FIG. 6. In contrast to the initial operating state shown in FIG. 6, the moving segment 5 in the operating state shown in FIG. 7 is located at maximum dorsiflexion.

Figure 8:
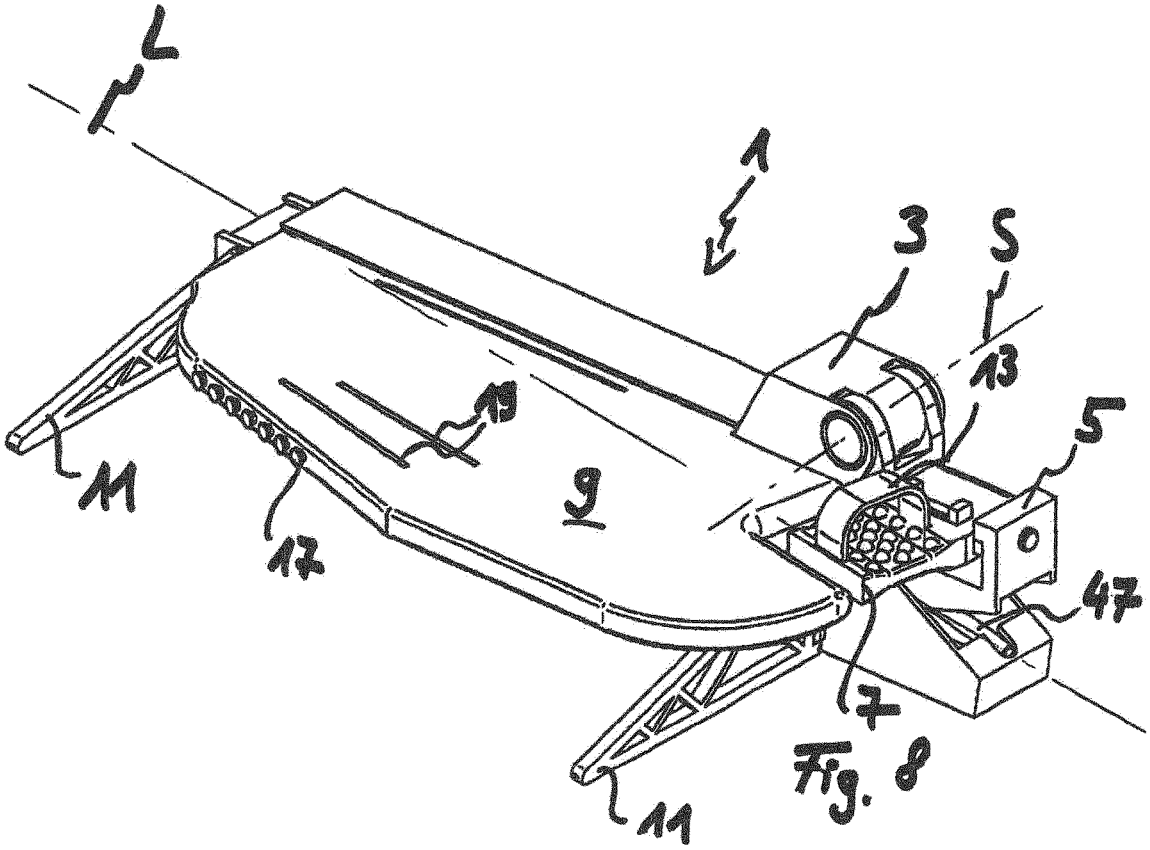
FIG. 8 shows a perspective view of a therapy device according to a second embodiment of the invention.

FIG. 8 shows a perspective view of a therapy device 1 according to another preferred illustrative embodiment of the invention. In the embodiment of the invention shown in FIG. 8 also, the therapy device 1 comprises a substantially symmetrical main body 3, in or on which a movably mounted moving segment 5 with an asymmetrical support surface 7 is arranged. Deployable stands 11 are also secured on the main body 3 which, in the state of use of the therapy device 1, not only ensure the stability of the elongate main body 3 but also serve to hold up the extremity support 9. In the transport state, the stands 11 can be easily folded back onto the main body 3, resulting in a compact unit (see FIG. 12). Moreover, the support surface 7 can be folded upward by 90° such that no parts protrude laterally from the main body 3.

As in the illustrative embodiment of the invention shown in FIGS. 1-7, the extremity support 9 in FIG. 8 can be connected releasably to the main body 3, for example via a plug or lock system. It is moreover clear that in this embodiment of the invention too the rotation axis S of the moving segment 5 corresponds substantially to the anatomical rotation axis of the body part to be treated, in this case the large toe. The rotation axis S of the moving segment 5 thus lies above the extremity support 9. To provide therapeutic treatment not only of the right foot but also of the left foot with the therapy device 1 according to FIG. 8, it is preferably not just the extremity support 9 but also the support surface 7 that can be connected releasably to the left-hand side of the main body 3 with respect to a longitudinal axis L thereof. The support surface 7 is designed in such a way that it can be releasably connected to the moving segment 5 via a clamp connection or similar connection and, if necessary, can be rotated through 180°, i.e. turned around, such that it can serve to receive the large toe of the left foot. In the present case, the support surface 7 is connected to the moving segment 5 by means of spring-mounted locking levers that engage in an elongate opening of the support surface 7. By pressing the pretensioned locking levers together, it is possible to remove the support surface 7 from the moving segment 5. In contrast to the embodiment of the invention shown in FIGS. 1-7, the moving segment 5 is not arc-shaped but substantially L-shaped or U-shaped and is actuated via a threaded spindle (threaded screw).

Figure 9:
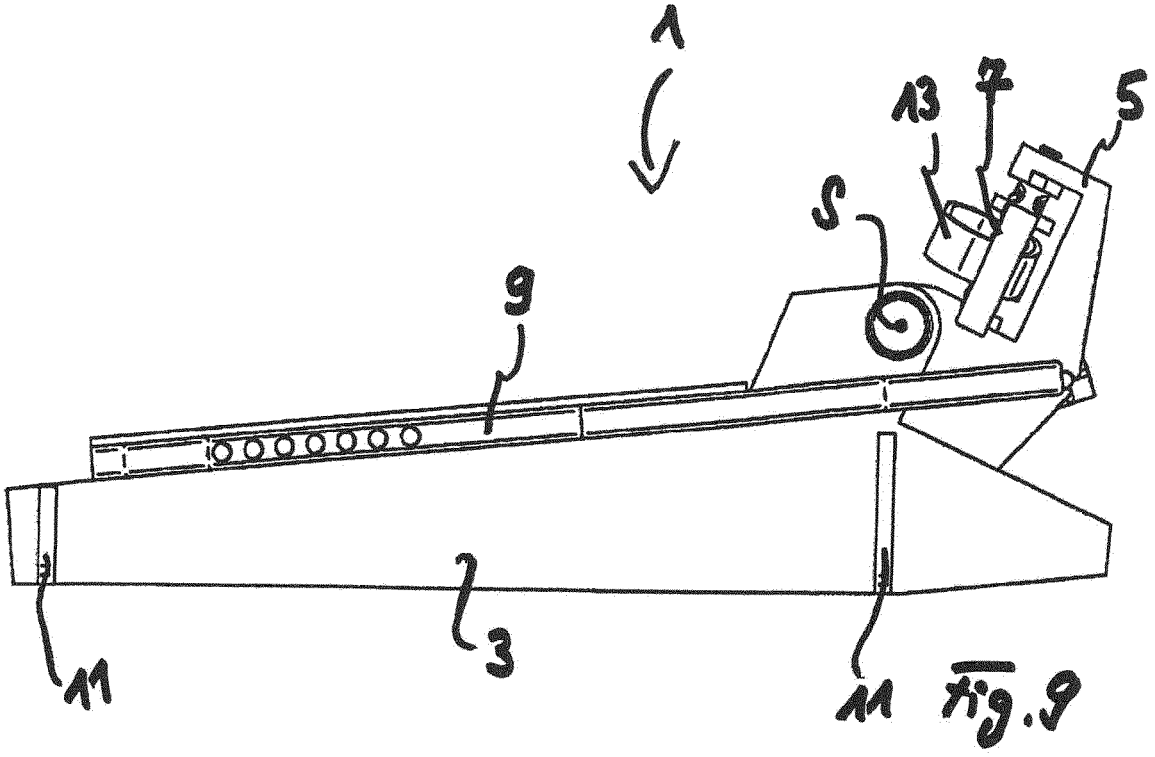
FIG. 9 shows a side view of the therapy device according to FIG. 8.
Figure 10:
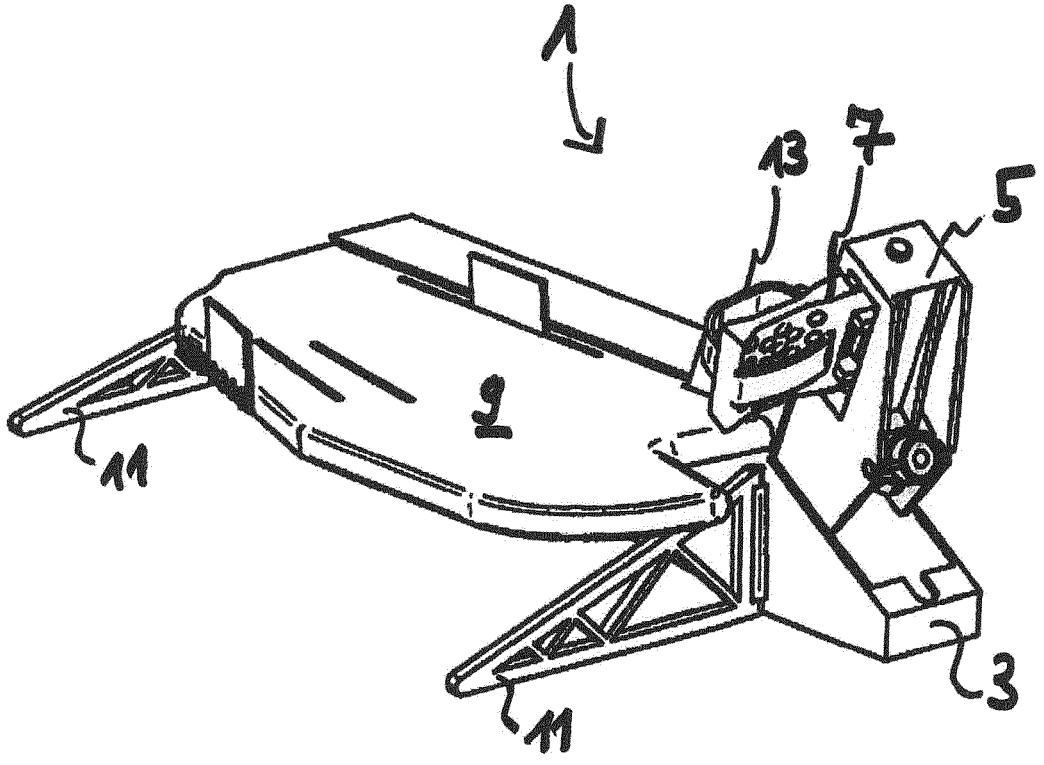
FIG. 10 shows a front face view of the therapy device according to FIG. 8 in a first state of movement.
Figure 11:
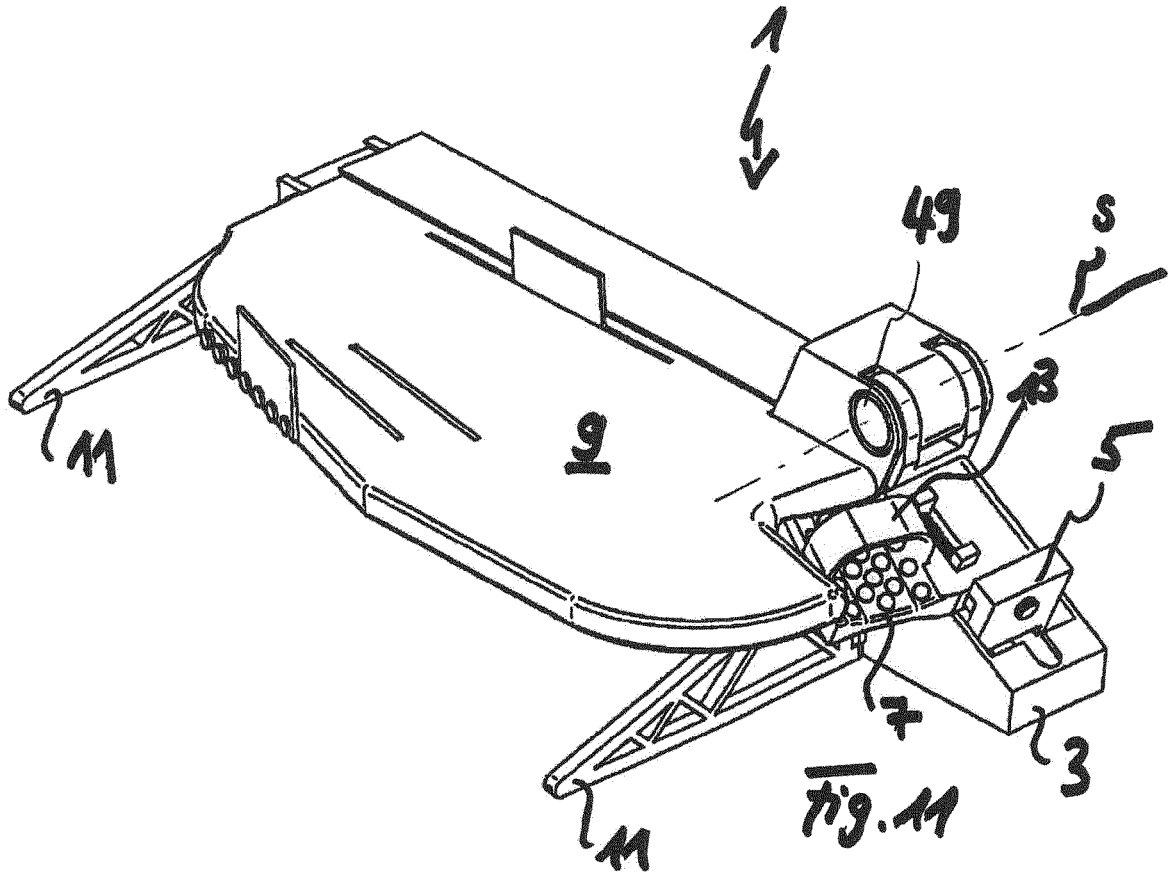
FIG. 11 shows a front face view of the therapy device according to FIG. 8 in a second state of movement.

FIG. 9 shows a side view of the therapy device according to FIG. 8 at maximum dorsiflexion of the moving segment 5. FIG. 10 shows a corresponding front view of the therapy device 1, while FIG. 11 shows the therapy device 1 in an operating state with maximum plantar flexion. In the embodiments of the invention shown in FIGS. 8-11 also, the angle of maximum plantar flexion is preferably ca. 30°, while the angle of maximum dorsiflexion is preferably 60°. The stated angles are each in relation to an initial position of the moving segment 5, in which position the support surface 7 lies substantially in a plane with the extremity support 9. Therefore, the total possible excursion of the moving segment 5 is preferably ca. 90°. It is stressed once again here that all of the stated angles can vary for different joints that are to be treated.

FIG. 12 shows once again a transport state of the therapy device 1, in which state the stands 11 are folded back onto the main body 3. Moreover, the support surface 7 is folded into a plane that corresponds substantially to the mid-plane of the therapy device 1.

Figure 12:
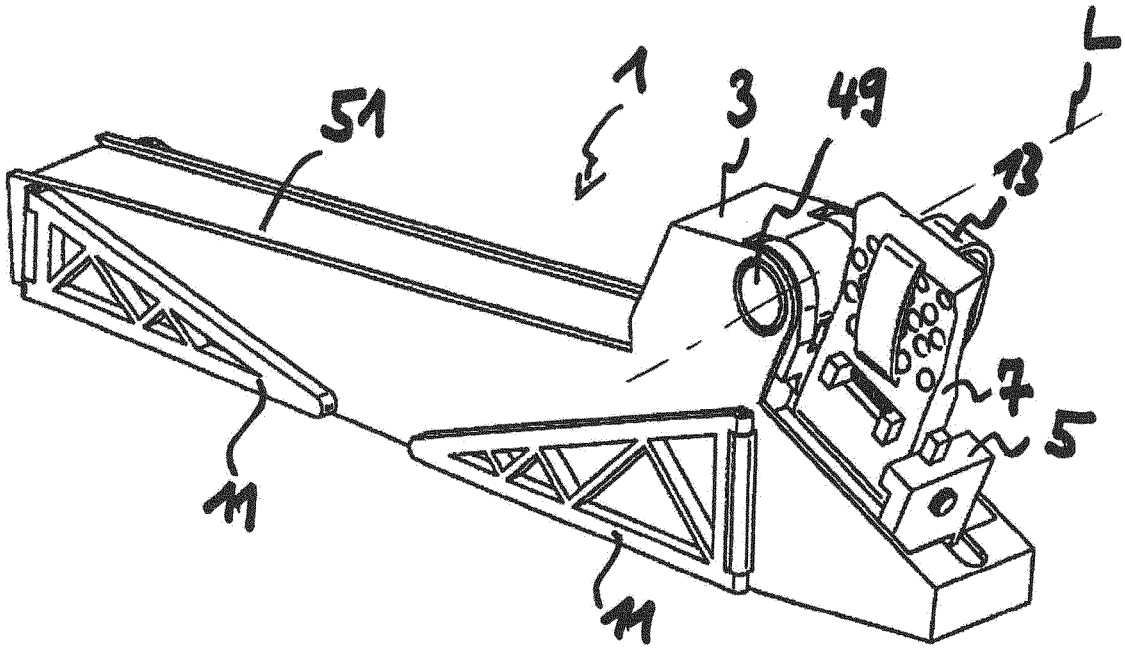
FIG. 12 shows a perspective view of the therapy device according to FIG. 8 in a transport state.

Moreover, it is clear from FIG. 12 that the moving segment 5 is mounted rotatably on the main body 3 by means of a bolt 49. The extremity support 9 (not shown in FIG. 12) is connected to the main body 3 via a guide system 51 with grooves, in particular a dovetail guide, into which a corresponding projection 53 (see FIG. 8) on both sides of the extremity support 9 can be pushed. Since the projection 53 (dovetail) is provided on the top and on the underside of the extremity support 9, it is possible for the extremity support 9 to be turned around, i.e. arranged on the left-hand side and on the right-hand side with respect to the longitudinal axis L of the main body 3. Therefore, in this embodiment of the invention too, a particularly flexible use for both body halves is possible.

Figure 13:
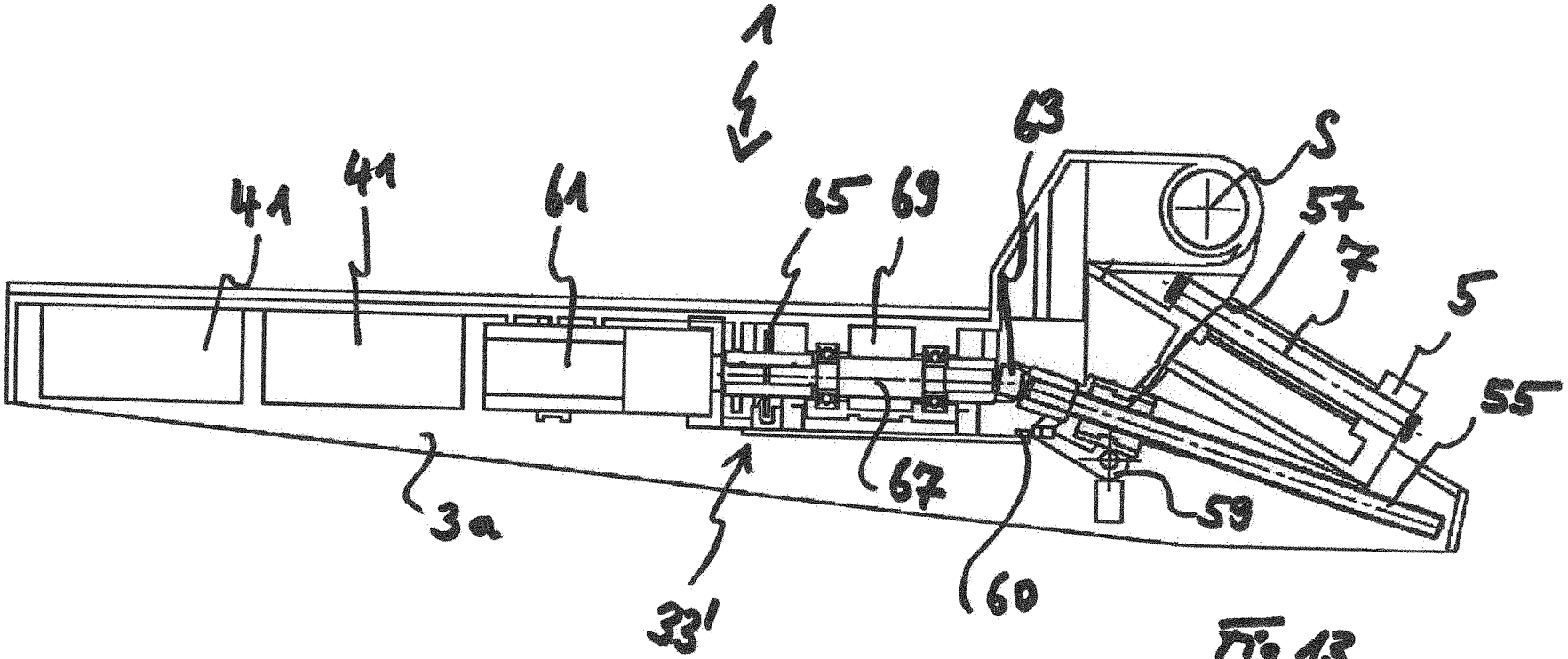
FIG. 13 shows a sectional view of the therapy device according to FIG. 8.

FIG. 13 shows an internal view of a housing half 3*a*, which clearly depicts the arrangement of a drive unit 33' for displacement of the moving segment 5. In contrast to the illustrative embodiment according to FIGS. 1-7, the moving segment 5 in the present case is displaced by a threaded screw 55 and a threaded nut 57. The threaded nut 57 is made from steel, from nonferrous metal such as copper, etc., from plastic or from some other suitable material and, for example, is injection-molded into a plastics part, which is clipped with locking lugs into cutouts in the moving segment. Moreover, at least one rotatably mounted actuation lever 59 is provided which is secured rotatably on the main body half 3*a* and which, with its other end, detects an end position of the moving segment 5 with the aid of a limit switch 60. The threaded screw 55 is driven by an electric motor 61, which is connected to the threaded screw 55 via a universal joint 63. The universal joint 63 transmits a rotation movement of the electric motor 61 to the spindle (threaded screw 55) and permits the pivoting movement thereof. In this embodiment of the invention, the electric motor is powered, for example, by accumulators 41. However, in this case too, a mains connection can be provided.

The electric motor 61 is connected to the universal joint 63 via a coupling 65 and via a mounted shaft 67. Moreover, a control system 69 is provided which controls the movement profile, in particular with respect to the speed and the pivoting angle of the moving segment 5. In this embodiment too, a mechanical or electrical overload safety system can moreover be provided which, if necessary, switches off the electric motor or is decoupled from the threaded screw 55. The overload safety system can be provided, for example, by means of a pressure sensor which is integrated in the support surface and detects toe pressure and sends resulting measurement signals to the control system. If the pressure exceeds a defined threshold value, a corresponding control signal can be generated, which switches off the electric motor.

Further types of drive that can be used to actuate the moving segment 5 on a pivot trajectory are, for example, an actuation by a linear actuator and by a torsion spring drive. The linear actuator can be mounted on a rocker rotatably in the main body 3 and in this way can effect a pivoting movement of a moving segment and therefore of a support surface. In the case of the torsion spring drive, a torsion spring can effect a pivoting movement of a moving segment 5 with the aid of a geared motor, an eccentric and toothed-wheel couplings.

Figure 14:
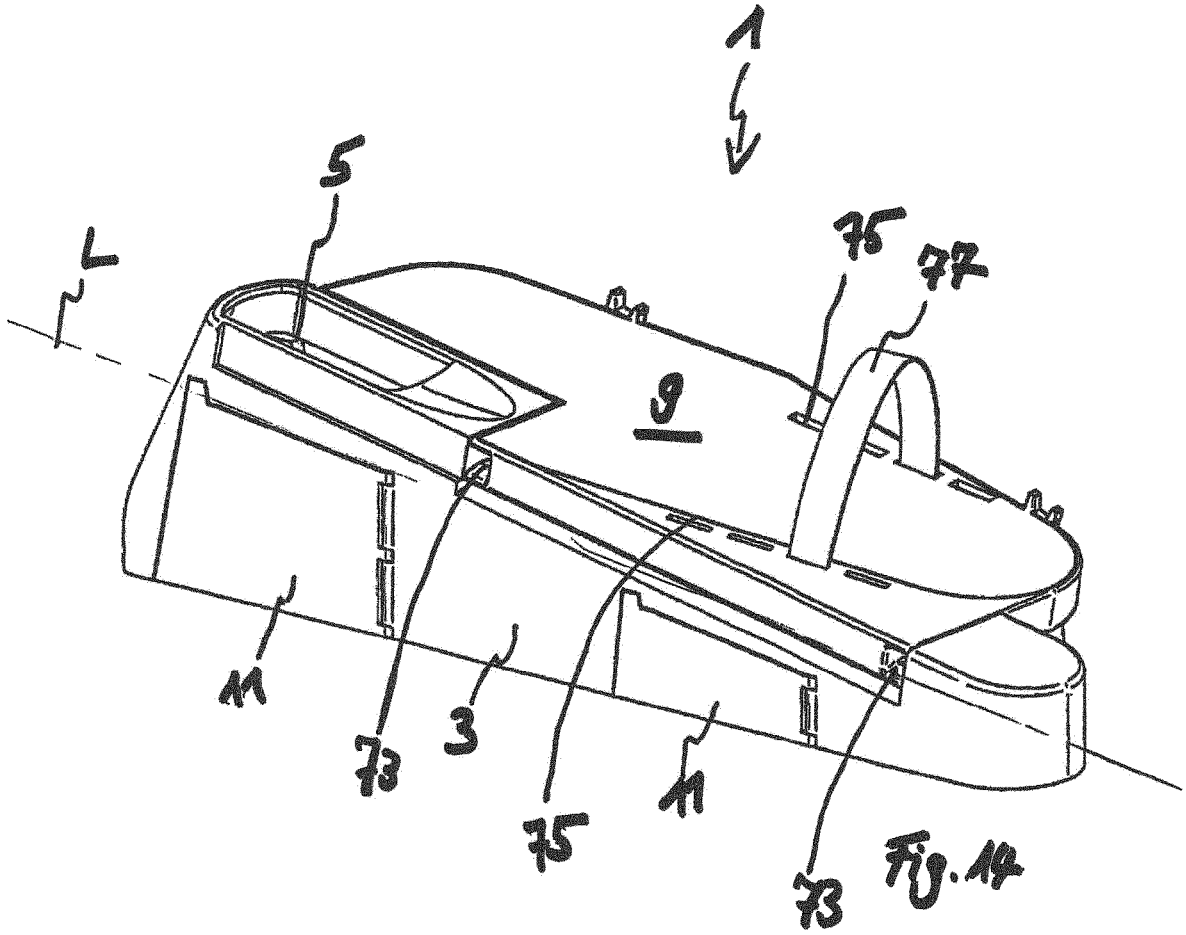
FIG. 14 shows a perspective view of a therapy device according to a further embodiment of the invention.
Figure 15:
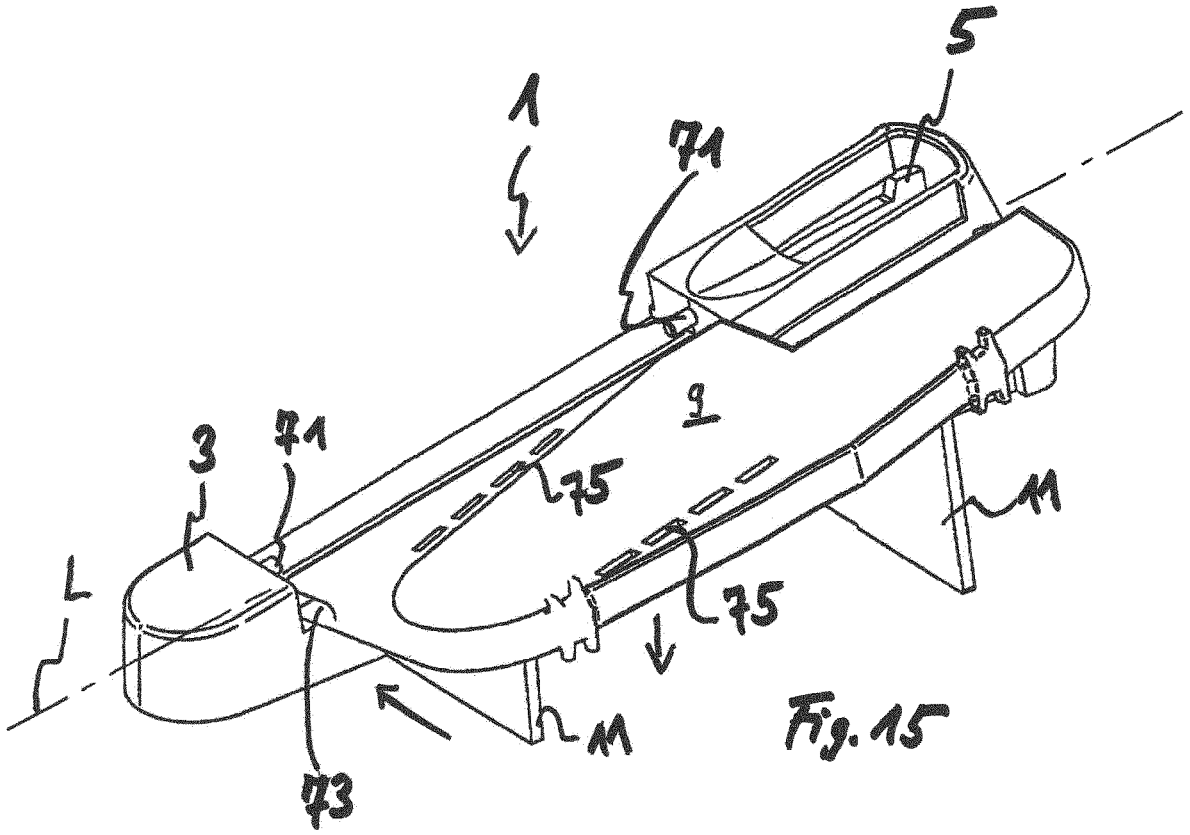
FIG. 15 shows a further perspective view of the therapy device according to FIG. 14.
Figures 16, 17:
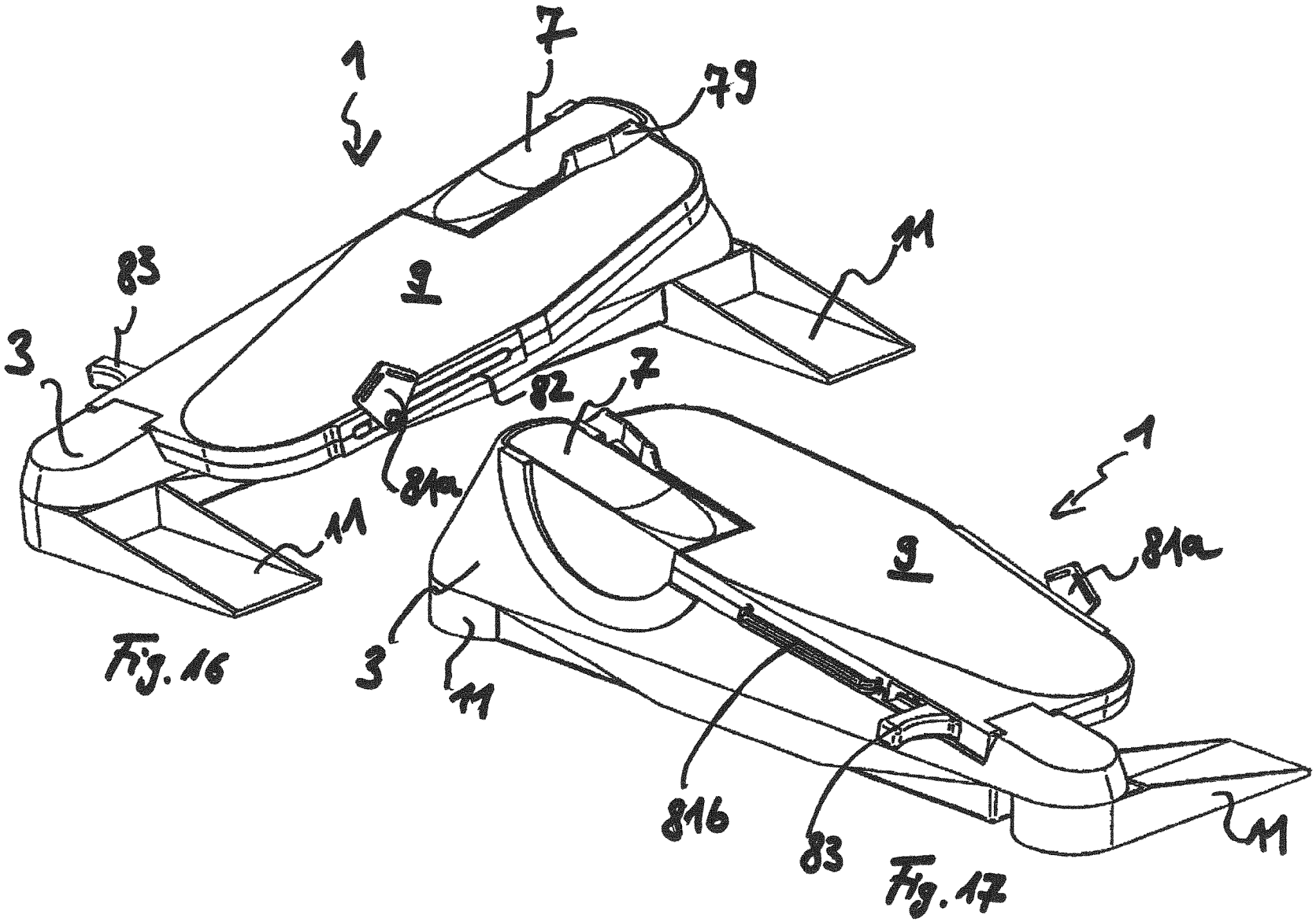
FIG. 16 shows a perspective view of the therapy device according to FIG. 14 with a differing extremity support.
FIG. 17 shows a perspective view of the therapy device with the extremity support according to FIG. 16.
Figure 18:
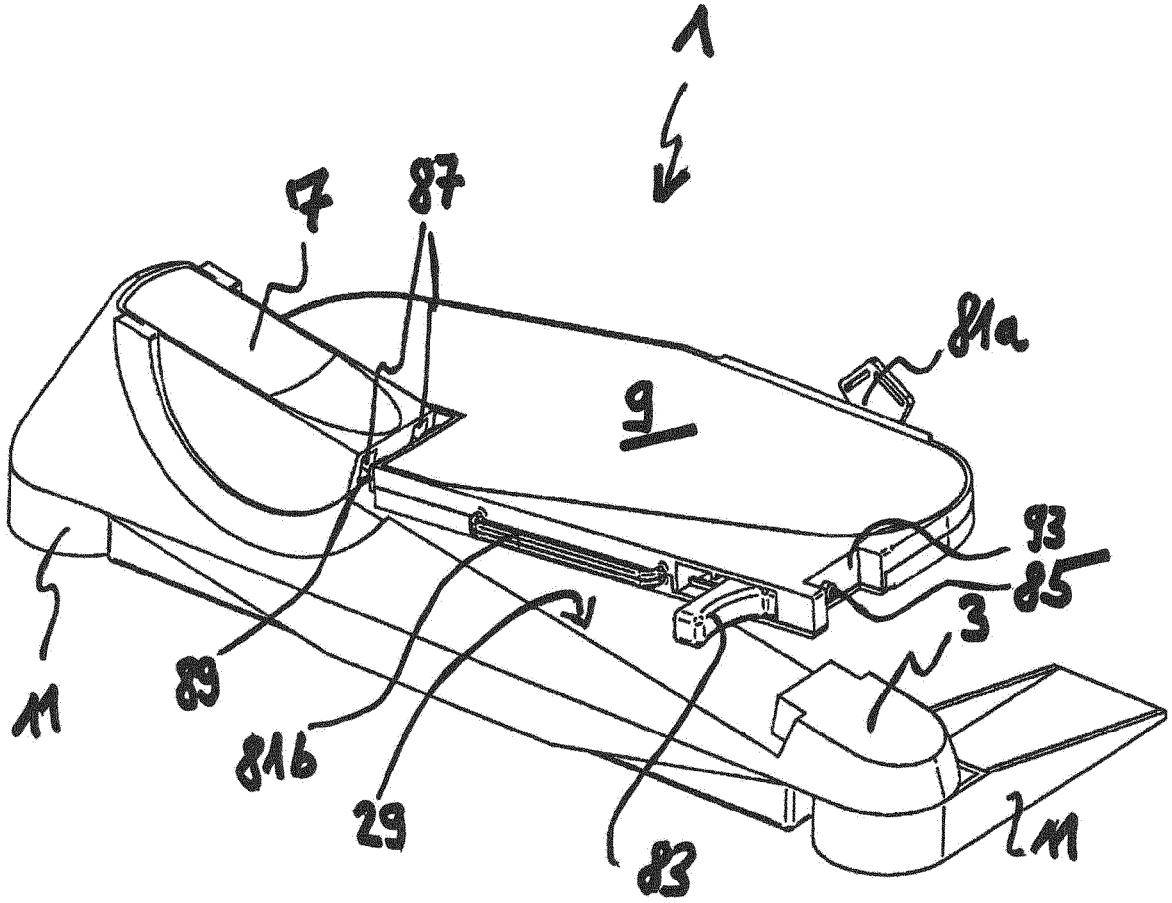
FIG. 18 shows a further perspective view of the therapy device with the extremity support according to FIG. 16.

FIGS. 14 and 15 show a further variant of a therapy device 1 according to the invention. The therapy device 1 is shown in each case without a support surface 7, such that the moving segment 5 can be seen. As in the other embodiments of the invention, the therapy device 1 shown in FIG. 14 has a main body 3, a moving segment 5, stands 11, and an extremity support 9 that can be connected to the main body 3. In this embodiment, the extremity support 9 is secured with the aid of bolts, which protrude into the recess 29 of the main body 3 for receiving the extremity support 9. To secure the extremity support 9 on the main body 3, the bolts 71 engage in corresponding grooves 73 of the extremity support 9.

In this illustrative embodiment too, the main body 3 has a symmetrical configuration, in such a way that the extremity support 9 can be arranged on both sides of the main body 3 with respect to its longitudinal direction L. For this purpose, the extremity support surface 9 is designed in the form of a removable disk which has mirror symmetry with respect to its mid-plane and therefore simply has to be turned through 180° about the longitudinal axis L for use with a body part on the left half of the body.

The extremity support surface 9 has a plurality of slits 75 which lie opposite and adjacent to each other and into which securing means 77 can be introduced in order to secure an extremity, in the present example to secure a foot in the area of the instep and/or of the heel. The slits serve for adaptation to different ergonomic circumstances, such that the therapy device 1 can be used for feet of different sizes.

The same applies also to FIGS. 16 to 19, which show a further embodiment of the invention. As can be seen clearly from FIG. 16 in conjunction with FIG. 17, the extremity support 9 here comprises securing means 81*a*, 81*b* which are arranged on opposite side edges of the extremity support 9 and are used for the variable securing of tapes, straps or similar securing material. This variant is advantageous since a strap can be provided both for securing the instep and also for securing the heel, in which case the size adjustment and the adaptation to the particular anatomical circumstances of the patient are accomplished by the fact that the securing means 81*a* is displaceable in a slit 82 by means of a screw, while the opposite securing means 81*b* is designed in the form of an elongate grip, which extends along the side wall of the extremity support 9. In this way, in order to adapt to the size, the securing means 81*a* simply has to be displaced in the slit 82.

Moreover, the extremity support 7 comprises a lever 83 which is spring-mounted and can actuate a bolt 85. To secure the extremity support 9, the main body 3 has recesses 87 into which corresponding projections 89 of the extremity support 9 can engage. At the opposite ends, the main body 3 has a projection 91 which can engage with a form fit in an indent 93 of the extremity support 9. By means of this design, the extremity support 9 can simply be clipped into the indent 29 of the main body 3, with the projections 89 first engaging in the recesses 87 of the main body 3 and the projection 91 then being connected with a form fit to the recess 93, the lever 83 being actuated and the bolt 85 being set back into the extremity support 9. Moreover, an opening (not visible in FIG. 18) can be provided in the projection 91, into which opening the bolt 85 can engage in the assembled state of the main body 3 and of the extremity support 9. To release the connection between the main body 3 and the extremity support 9, the lever 83 then simply has to be actuated in order to release the engagement of the bolt 85. Thus, a simple clamped connection is provided between the extremity support 9 and the main body 3 and, in particular as a result of the symmetrical design of the main body 3, allows the extremity support 9 to be used on both sides.

Figure 19:
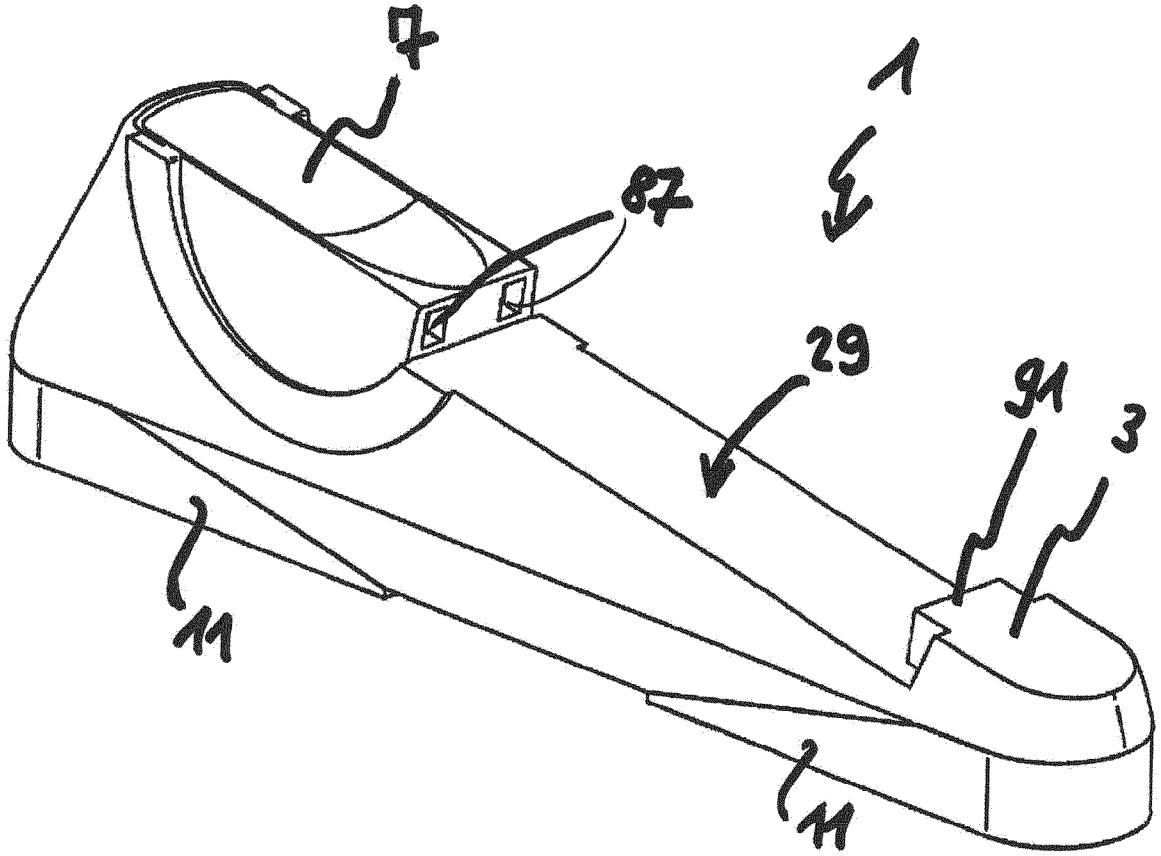
FIG. 19 shows a detailed view of the therapy device according to the invention without an extremity support.

FIG. 19 shows a further perspective view of the main body 3. As can be seen from the figure, this illustrative embodiment likewise comprises modifiable stands, which can be moved from a supporting position to a space-saving transport position shown in FIG. 19.

Figures 20, 21:
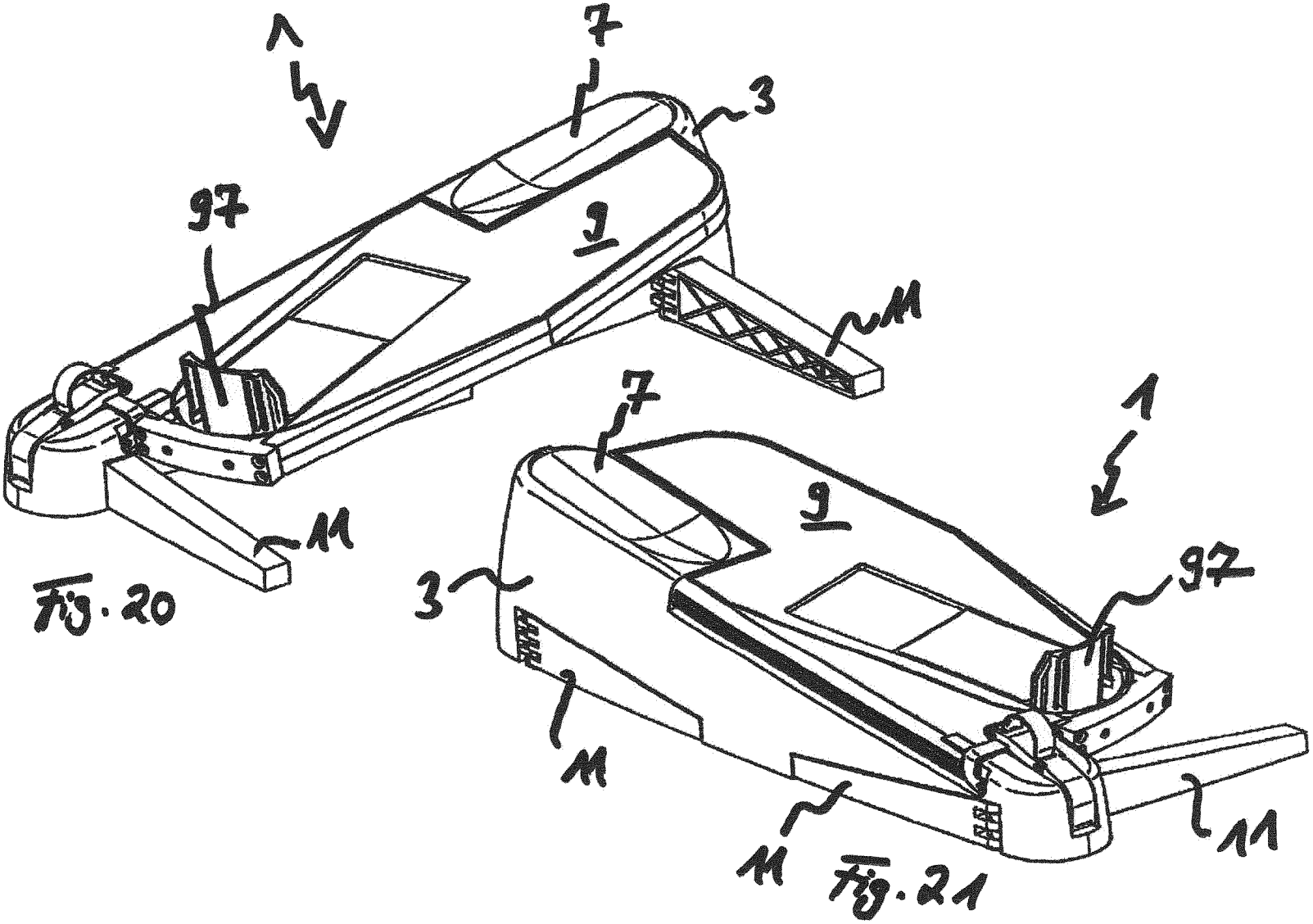
FIG. 20 shows a perspective view of a therapy device according to a further embodiment of the invention.
FIG. 21 shows a further perspective view of the therapy device according to FIG. 20.
Figure 22:
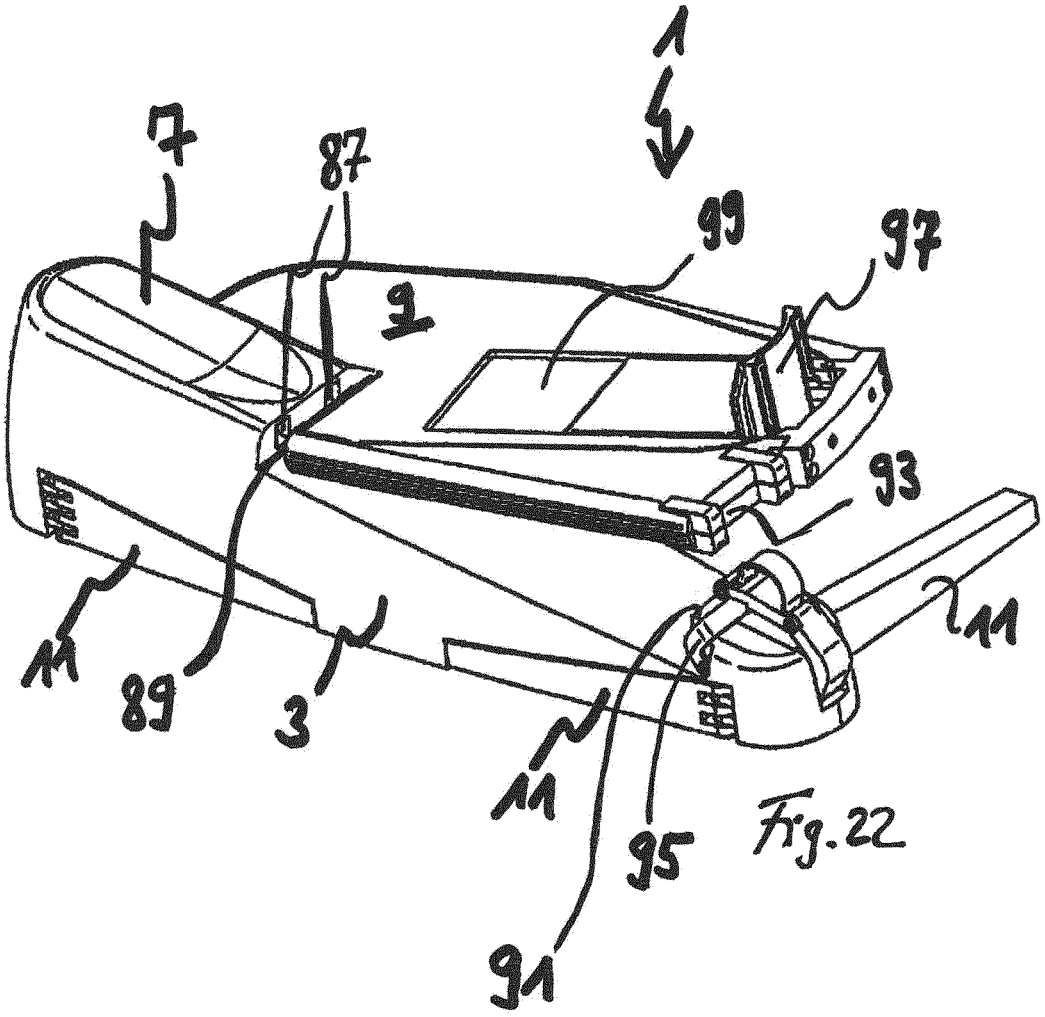
FIG. 22 shows a further perspective view of the therapy device according to FIG. 20.

FIGS. 20 to 22 show a further embodiment of the invention, which comprises another advantageous connection mechanism between the extremity support 9 and the main body 3 and in which the extremity support 7 comprises an advantageous mechanism for individual adaptation of the size of the extremity support.

As also in the illustrative embodiment according to FIGS. 16-19, the main body 3 has recesses 87 for receiving projections 89 of the extremity support 7. It will be appreciated that the recesses can also be provided on the extremity support 9 and the projections on the main body 3. Moreover, the main body 3 has a projection 91 and the extremity support 9 has a form-fit recess 93 for the latter. To connect the extremity support 9 to the main body 3, the projections 89 are inserted into the recesses 87, and the opposite end of the extremity support 9, i.e. the recess 93, is connected with a form fit to the projection 91 of the main body 3. To fix the extremity support 9 on the main body 3, a clamp mechanism 95 is provided in the form of a bow which can be actuated by hand in such a way that, in the assembled state of the extremity support 9 and of the main body 3, it bears on the extremity support 9.

The embodiment according to FIGS. 21 and 22 comprises a particularly preferred, separate and movable heel abutment element 97, which is movable in a suitable guide structure 99 in such a way that the extremity support 9 and in particular the heel abutment element 97 can be individually adapted to different sizes of feet.

FIGS. 21 and 22 also show clearly that two stands 11 in each case are provided on both sides of the main body 3, i.e. a total of four stands are provided, which can be suitably swiveled out depending on which side the body part to be treated is located (left half or right half of the body).

Figure 23:
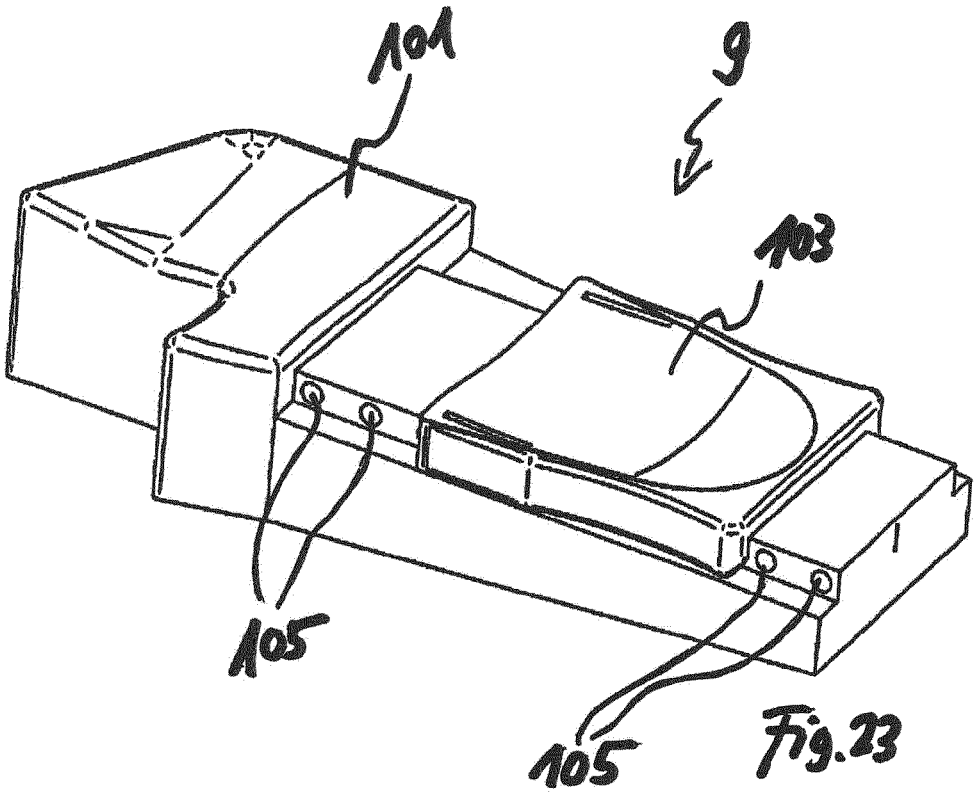
FIG. 23 shows a perspective view of an extremity support according to an embodiment of the invention.
Figure 24:
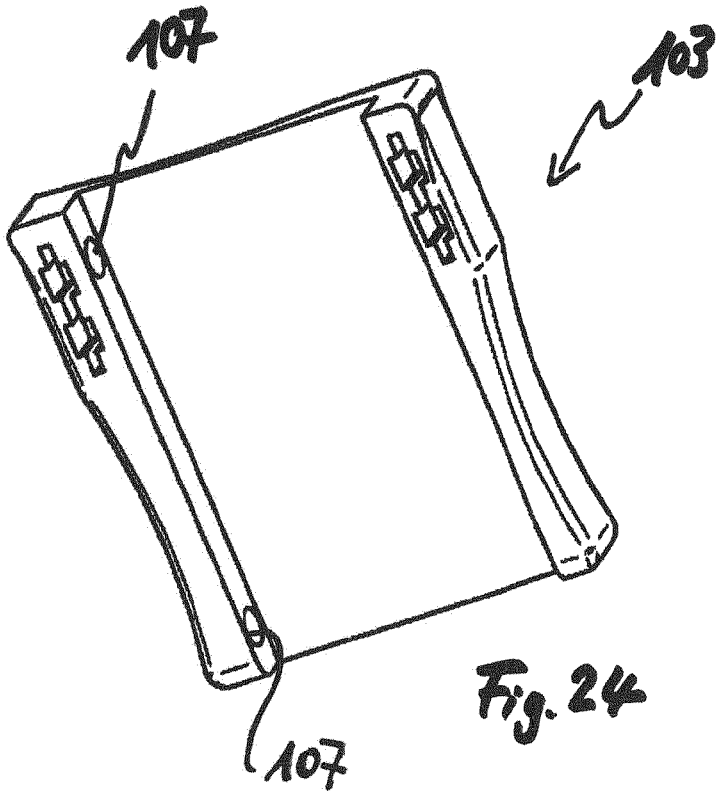
FIG. 24 shows a detailed view of a heel support of the extremity support according to FIG. 23.

FIGS. 23 and 24 show a further illustrative embodiment of an extremity support 9, which is made in two parts, in particular from plastic. The extremity support 9 here comprises a toe part 101, and a heel part 103 which is displaceable on the toe part 101 in order to individually adapt the extremity support 9 to different foot sizes. The heel part 103 can be fixed, for example, via suitable knobs 105 on the toe part 101, into which can latch corresponding recesses 107 of the heel part 103.

Figures 25, 26:
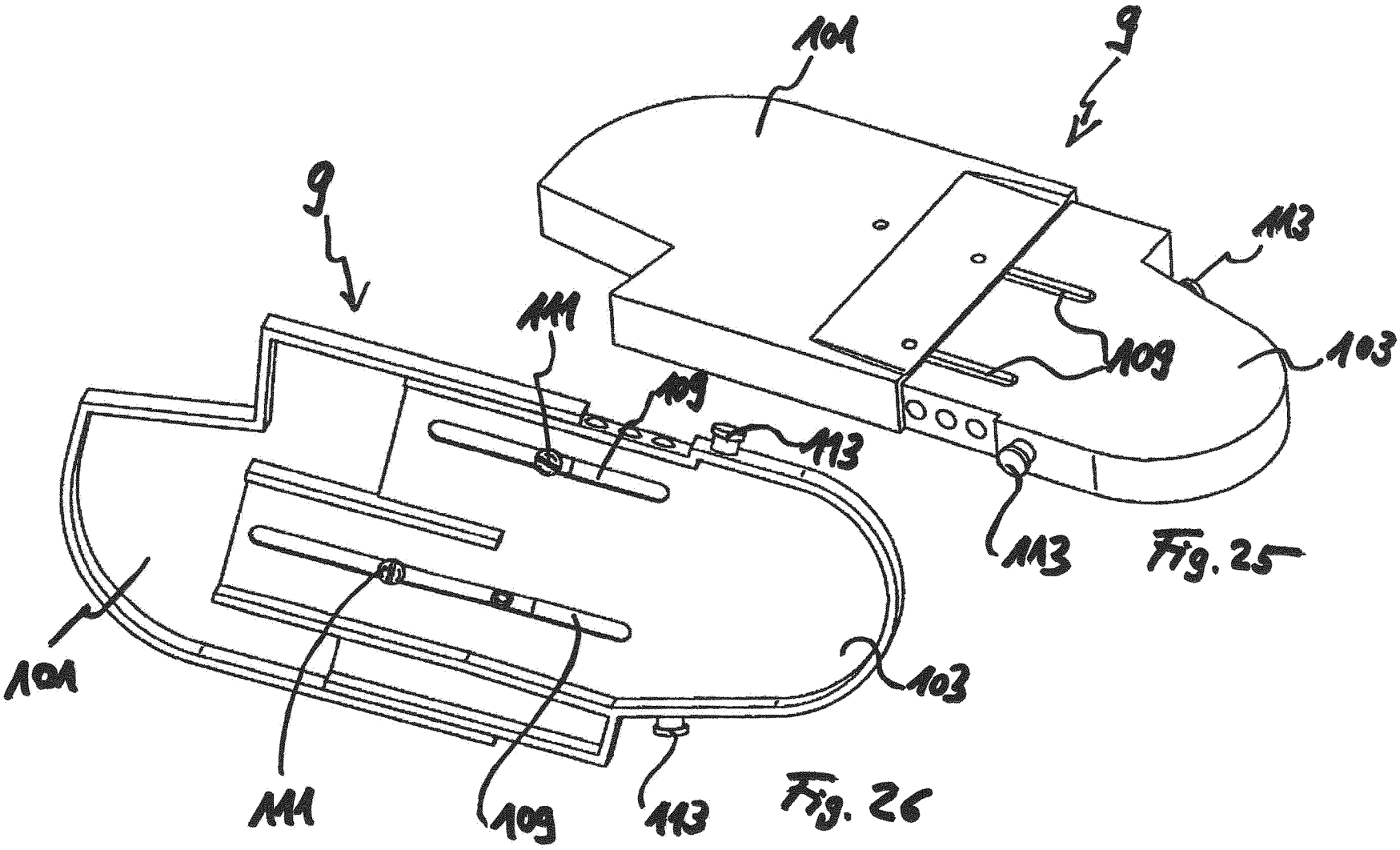
FIG. 25 shows a perspective view of an extremity support according to a further embodiment of the invention.
FIG. 26 shows a view of the underside of the extremity support according to FIG. 25.

FIGS. 25 and 26 show a further illustrative embodiment of a two-part extremity support 9, in which the position of the heel part, separate from the toe part, can be modified relative to the toe part with the aid of slits 109 and screws 111 mounted in the latter. In this way, the extremity support 9 can be individually adapted to different foot sizes. The securing in the desired position is effected by tightening the screws 111. Moreover, in this embodiment of the invention, the extremity support 9 preferably comprises securing elements 113 for straps or tapes for fixing the heel and/or instep on the extremity support 9.

Figure 27:
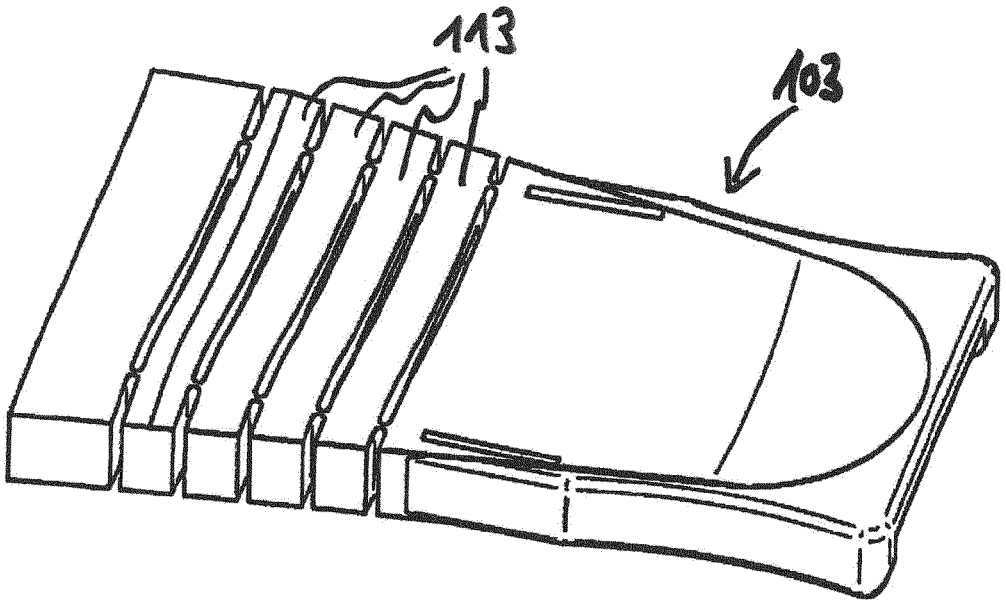
FIG. 27 shows a view of an extremity support having break segments.

Consideration is also given to a variant according to FIG. 27 in which the extremity support, in particular the heel part 103, has a tile-like design and comprises so-called break segments 113 which, if necessary, can be broken off from the extremity support in order to reduce the size of the extremity support.

Overall, the present invention makes available an advantageous therapy device which is particularly compact, in particular for transport, and which can be produced easily and cost-effectively and, in addition, can be used flexibly for body parts on the left half and also on the right half of the body. This is achieved in a particularly advantageous manner by an extremity support designed separately from the main body 3, while the main body 3 comprises the actual therapy device in the form of the moving segment 5, the support 7 and the drive mechanism 33.

The stand 11 can be formed separately from the main body 3 and can be secured thereon, in particular reversibly. Moreover, it can be mounted rotatably or pivotably on the main body 3. In the latter embodiment, two or more stands, in particular four stands, can be provided on the main body and can each be moved manually from a transport state to a state of use. If four stands are provided, two stands can be arranged on each of the two sides of the main body 3. If only two stands are provided, they can preferably be pivoted to the left or to the right side of the main body 3. It is possible that the stands are not simply suitable for supporting and stabilizing the main body, but that they also assume a supporting function for the extremity support.

In the context of the above-described embodiments of the invention, an electrical drive mechanism for generating a pivoting movement of the moving segment 5 was explained. However, it is also conceivable in principle to use a hydraulic or pneumatic drive mechanism. The position of the moving segment 5 can moreover be determined not only using the described fork-shaped light barrier, but also, for example, using a Hall IC (encoder), a limit switch or a potentiometer with pinion. For position determination, the therapy device preferably comprises a printed circuit board separate from the control.

As regards a releasable connection between the extremity support 5 and the main body 3, several coupling mechanisms have been explained here which basically involve a clipping, locking or clamping connection. However, it is also conceivable in principle to use other connections which allow the extremity support to be used on both sides in the manner of a reversible plate. For example, a pivotable mounting of the extremity support about a longitudinal axis L of the main body 3 is conceivable which, if necessary, can be moved (pivoted) to the left or right with respect to the longitudinal axis L of the main body 3. For transport, it is also possible, for example, to provide a cassette which is preferably integrated in the main body 3 and in which the extremity support can be stowed. It is also conceivable to use two extremity supports which are arranged on both sides with respect to the longitudinal axis L of the main body 3 and which are each stowed in a cassette, wherein the left or right extremity support surface can be folded out according to requirements.

The movement of the moving segment can be controlled using control technology and in particular by position detection. However, mechanical control of the rotation movement, for example by means of a torsion spring, is also possible. It is also conceivable for movement to be limited by abutment elements. Moreover, the control can preferably implement various programs which, for example, provide different movement patterns and/or speeds, etc.

The geometry of the main body 3 overall is preferably such that the longitudinal axis L, or its axis of symmetry, coincides with the longitudinal axis of the body part that is to be moved. For this purpose, provision is preferably made that the axis of symmetry coincides with the axis of symmetry of the fixing mechanism for fixing the body part.

Moreover, as regards the body part being mounted movably on the support surface 7, a ball bed has been described which permits multidimensional mobility of the body part in any direction on the ball bed. However, an embodiment is preferred in which a support surface is provided in the form of a dual-motion carriage which ensures the necessary mobility of the body part on the moving segment 5. The support surface can then be moved, for example in the longitudinal direction L on the one hand and transverse to the longitudinal direction L on the other hand, by means of suitable carriages.

Figure 28:
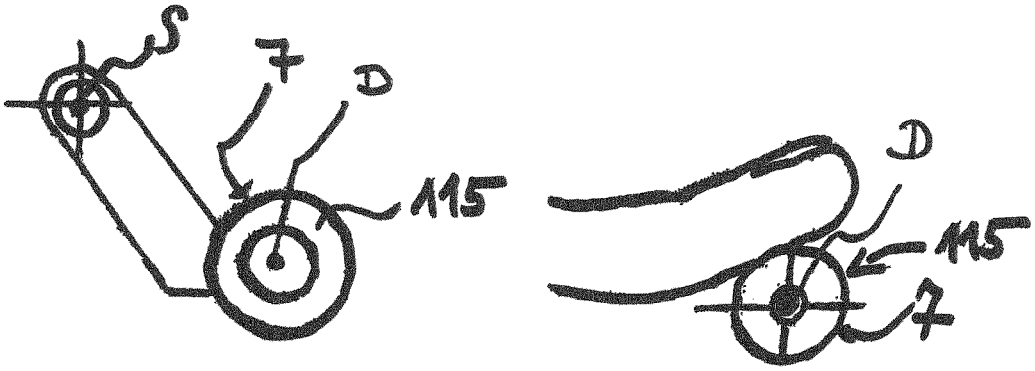
FIG. 28 shows a schematic view of a roller-like support surface.

Moreover, one-dimensional mobility of the body part on the support surface 7 can also be provided not by ball elements but instead, for example, by means of a roller element 115 according to FIG. 28, of which the rotation axis D is perpendicular to the longitudinal axis L of the main body 3. The large toe can then be mounted movably on the roller element 115, such that the circumferential surface of the roller element 115 thus forms the support surface for the body part that is to be treated.

Figure 29:
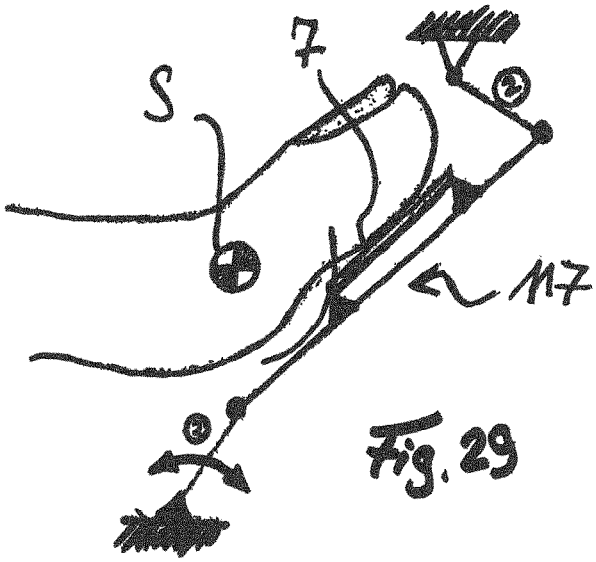
FIG. 29 shows a first embodiment of a movable bearing of a large toe by means of a lever system.
Figure 30:
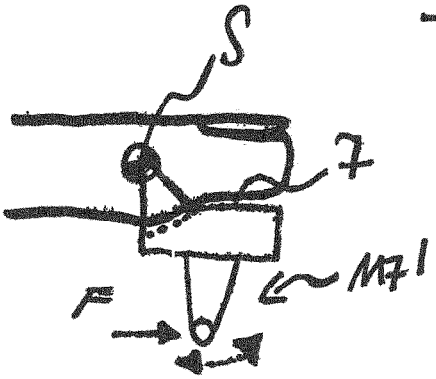
FIG. 30 shows a first embodiment of a movable bearing of a large toe by means of a lever system.
Figure 31:
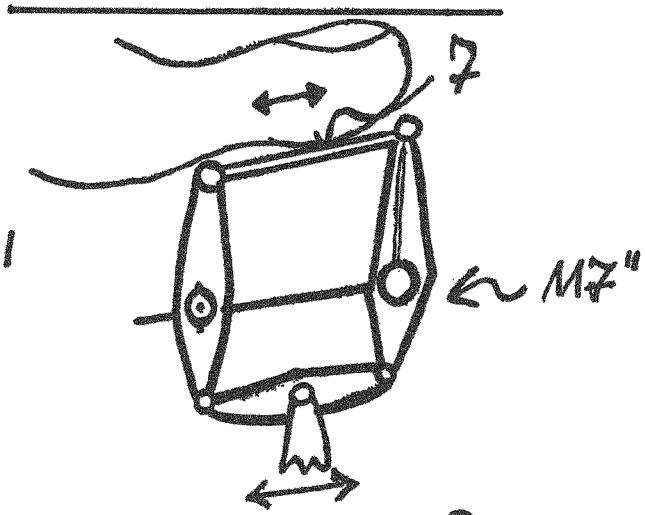
FIG. 31 shows a first embodiment of a movable bearing of a large toe by means of a lever system.

Alternatively, one-dimensional mobility of the body part can also be provided by a lever system 117, 117' or 117" according to FIGS. 29-31. Here, a lever connection between the moving segment and the support surface 7 ensures that, during a pivoting movement of the moving segment 5, the body part to be treated is mounted movably on the support surface relative to the moving segment. In this case, the support surface 7 is thus displaceable relative to the moving segment 5.

LIST OF REFERENCE SIGNS

1 therapy device
3 main body
3*a*, 3*b* main body half
5 moving segment
7 support surface
9 extremity support
11 stands
13 fixing mechanism
15 ball elements
17 knobs
19 slits
21 side wall
23 opening
25 connection means
27 groove

29 recess
31 guide rail
33, 33' drive mechanism
35 worm gear
37 universal joint
39 electric motor
41 accumulator
42 control system
45 coupling
46 connecting shaft
49 bolt
51 guide system
53 projection
55 threaded screw
57 threaded nut
59 actuation lever
60 limit switch
61 electric motor
63 universal joint
65 coupling
67 bearing shaft
69 control system
71 bolt
73 groove
75 slits
77 securing means
79 Vertical plate
81 securing mechanism
82 slit
83 lever
85 bolt
87 recess
89 projection
91 projection
93 recess
95 fixing means
97 heel abutment element
99 guide structure
101 toe part
103 heel part
105 knobs
107 recess
109 slit
111 screw
113 break segments
115 roller element
117 lever system
117' lever system
117" lever system
L longitudinal direction
S rotation axis
D rotation axis

The invention claimed is:

1. A therapy device for postoperative treatment of a large toe, the therapy device comprising:

a main body; and a moving segment with a support surface for supporting the large toe to be treated, the moving segment mounted to the main body in such a way as to be pivotable about a rotation axis, the main body designed to bear an extremity support, wherein the support surface comprises a vertical plate and a strap, the vertical plate having a shape configured to position the large toe on the support surface and the vertical plate further configured to separate the large toe from a neighboring toe so as to prevent bruising of the large toe by the neighboring toe, the strap configured to fix the large toe to the support surface as positioned on the support surface.

2. The therapy device according to claim 1, wherein the main body is substantially symmetrical.

3. The therapy device according to claim 1, wherein the rotation axis of the moving segment substantially coincides with an anatomical rotation axis of a joint of the large toe to be treated.

4. The therapy device according to claim 1, wherein the support surface is connected to the moving segment in one of a releasable manner and/or a displaceable manner.

5. The therapy device according to claim 1, wherein the support surface fixably supports the large toe to be treated.

6. The therapy device according to claim 1, wherein the support surface is displaceable relative to the moving segment.

7. The therapy device according to claim 1, wherein the main body comprises at least one releasable and/or displaceable stand, the stand to support the main body and/or the extremity support.

8. The therapy device according to claim 7, wherein the main body has at least one recess for receiving the at least one releasable and/or displaceable stand.

9. The therapy device according to claim 1, wherein the main body comprises an integrated drive mechanism for manual or electrical displacement of the moving segment.

10. The therapy device according to claim 9, wherein the drive mechanism has a threaded spindle drive, an arc segment drive, a linear actuator, or a flexible shaft.

11. The therapy device according to claim 9, wherein the integrated drive mechanism cooperates with an overload safety system.

12. The therapy device according to claim 1, wherein the therapy device comprises the extremity support that is releasably connectable to the main body of the therapy device.

13. The therapy device according to claim 12, wherein the extremity support is adjustable in size.

14. The therapy device according to claim 13, wherein the extremity support has a heel part adjustable in at least one of vertical direction and longitudinal direction.

15. The therapy device according to claim 13, wherein the extremity support has break segments.

16. The therapy device according to claim 12, wherein the extremity support fixes extremities to the extremity support.

17. The extremity support according to claim 16, wherein the extremity support comprises tapes to fix the extremities to the extremity support.

18. The therapy device according to claim 12, wherein the extremity support is designed as an injection molded part.

19. The therapy device according to claim 12, wherein the extremity support is produced by 3D printing or milled from a solid block.

20. The therapy device according to claim 1, wherein the main body is designed to bear the extremity support optionally either on a left-hand side or on a right-hand side of the main body.

21. A kit comprising:

a therapy device for postoperative treatment of a large toe, the therapy device comprising:

a main body; and a moving segment with a support surface for supporting the large toe to be treated, the moving segment mounted to the main body in such a way as to be pivotable about a rotation axis, wherein the support surface comprises a vertical plate and a strap, the vertical plate having a shape configured to position the large toe on the support surface and the vertical plate further configured to separate the large toe from a neighboring toe so as to prevent bruising of the large toe by the neighboring toe, the strap configured to fix the large toe to the support surface as positioned on the support surface; and an extremity support releasably connectable to the main body of the therapy device.

* * * * *